US005980132A

United States Patent [19]

Kawai

[11] Patent Number: 5,980,132

[45] Date of Patent: Nov. 9, 1999

[54] IMAGE FORMING APPARATUS WITH MEANS FOR MAINTAINING CONSTANT DISTANCE BETWEEN RECORDING HEAD AND RECORDING SHEET

[75] Inventor: Tsutomu Kawai, Yokohama, Japan

[73] Assignee: Canon Kabushiki Kaisha, Tokyo, Japan

[21] Appl. No.: 08/982,304

[22] Filed: Dec. 1, 1997

Related U.S. Application Data

[63] Continuation of application No. 08/220,285, Mar. 30, 1994, abandoned.

[30] Foreign Application Priority Data

Mar. 31, 1993 [JP] Japan ..... 5-95037
Jul. 13, 1993 [JP] Japan ..... 5-195367

[51] Int. Cl.[6] ..... B41J 25/308

[52] U.S. Cl. ..... 400/56; 400/636.2; 347/8

[58] Field of Search ..... 400/56, 58, 625, 400/636, 636.2, 636.3, 637, 637.2, 638, 639; 347/8, 104

[56] References Cited

U.S. PATENT DOCUMENTS

| | | | |
|---|---|---|---|
| 2,233,955 | 3/1941 | Miller | 400/641 |
| 2,831,562 | 4/1958 | Saliamonas | 400/641 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,575,267 | 3/1986 | Brull | 400/56 |
| 4,608,577 | 8/1986 | Hori | 347/66 |
| 4,717,274 | 1/1988 | Kimura | 400/636.1 |
| 4,723,129 | 2/1988 | Endo et al. | 347/56 |
| 4,740,796 | 4/1988 | Endo et al. | 347/56 |
| 4,971,468 | 11/1990 | Yokoi | 400/636.2 |

FOREIGN PATENT DOCUMENTS

| | | | |
|---|---|---|---|
| 478300 | 4/1992 | European Pat. Off. | 400/708 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 225077 | 10/1986 | Japan | 400/58 |
| 63-286374 | 11/1988 | Japan | 400/636.2 |
| 2-258370 | 10/1990 | Japan | 400/708 |
| 303872 | 12/1990 | Japan | 400/58 |
| 4-279371 | 10/1992 | Japan | 400/708 |
| 4-288280 | 10/1992 | Japan | 400/708 |
| 5-124284 | 5/1993 | Japan | 400/636 |
| 6-001014 | 1/1994 | Japan | 400/708 |

OTHER PUBLICATIONS

IBM Technical Disclosure Bulletin, vol. 24 No. 11B, Apr. 1981 "Automatic Adjusting Document Validation Station", pp. 6158–6159, T. W. Anderson.

*Primary Examiner*—Stephen R. Funk
*Attorney, Agent, or Firm*—Fitzpatrick, Cella, Harper & Scinto

[57] ABSTRACT

An image forming apparatus, with an image forming device for forming an image on a sheet, and a position restricting unit being in contact with a surface of the sheet on a side of said image forming apparatus and keeping distance between the sheet and said image forming device constant.

14 Claims, 18 Drawing Sheets

IMAGE FORMING APPARATUS WITH MEANS FOR MAINTAINING CONSTANT DISTANCE BETWEEN RECORDING HEAD AND RECORDING SHEET

This application is a continuation of U.S. patent application Ser. No. 08/220,285, filed Mar. 30, 1994, now abandoned.

BACKGROUND OF THE INVENTION

1. Field of the Invention

The present invention relates to an image forming apparatus for recording image information on a record material (sheet) or the recording apparatus thereof, in particular, to a recording apparatus using an ink jet recording system for spraying ink corresponding to a signal.

2. Related Background Art

Conventionally, image forming apparatus (recording apparatuses) for use as printers, copiers, facsimile machines, and so forth drive an energy generating member for a record head corresponding to image information received so as to record a dot pattern image on a record material such as a piece of paper or a plastic sheet.

However, in addition to such an ink jet recording system, wire-dot systems, thermal systems, laser beam systems, and so forth are known. Next, with reference to FIG. 23, an ink jet recording system will be described. A record head 351 discharges ink on a record paper sheet P corresponding to image information so as to record the image on the record paper sheet P. The record head 351 is disposed on a carriage 352. The carriage 352 is connected to a lead screw 353. The lead screw 353 is rotated by a drive source (not shown) so as to reciprocate the carriage 352 along a guide shaft 354 (perpendicular to the plane of the drawing). While the carriage 352 is moved, the record head 351 is driven so as to discharge ink on the record paper sheet P.

A conveying means conveys the record paper sheet P to the record head 351. The conveying means has a conveying roller 355 and a pinch roller 356. The conveying roller 355 is disposed on the rear side of the record paper sheet P. The pinch roller 356 pinches the record paper sheet P along with the conveying roller 355. Thus, the record paper sheet P pinched by the conveying roller 355 and the pinch roller 356 is conveyed to a support table (platen) disposed at a record position. The conveying roller 355 is disposed on a drive side (drive force is received and thereby rotated). The surface of the conveying roller 355 is coated with a high frictional material (for example, rubber). In addition, the pinch roller 356 is disposed on a follower side (rotated by the conveying roller 355). The pinch roller 356 is for example a metal roller. Both ends of a rotating shaft of the pinch roller 356 are tensioned by a pair of leaf springs 357. Thus, the pinch roller 356 presses the conveying roller 355.

The distance between the record head 351 and the front surface of the record paper sheet P is given by:

$$\delta=\delta_0-t$$

where $\delta$ is the distance (record head distance) between the record head 351 and the front surface of the record sheet P; and $\delta_0$ is the distance between the record head 351 and the support table. Thus, the ink spray distance varies corresponding to t. Consequently, the position of the record head 351 or conveying roller 355 should be adjusted corresponding to the sheet thickness t.

SUMMARY OF THE INVENTION

An object of the present invention is to solve the problems involved in the above-described related art and provide a recording apparatus that can keep conveying amount and record head distance constant regardless of the type of record material.

To accomplish the above objects, the present invention is a recording apparatus comprising a record means for recording image information on a record material, a platen for supporting the record material at a record position, and a conveying means for conveying the record material to the record means, wherein the conveying means has a pair of rotating members that are tensioned and brought in contact with each other, the rotating members being a driving rotating member and a follower rotating member, the driving rotating member being opposed to the record means, the follower rotating member being opposed to the platen.

Since the driving rotating member is opposed to the record means and the follower rotating member is opposed to the platen, the axis of the driving rotating member is fixed and the axis of the follower rotating member is movable. Thus, the conveying amount and the record head distance can be kept constant regardless of the type of record material (such as thick paper, thin paper, normal paper, or plastic sheet).

DETAILED DESCRIPTION OF THE PREFERRED EMBODIMENTS (First Embodiment)

Next, a first embodiment according to the present invention will be described.

Figure 1:
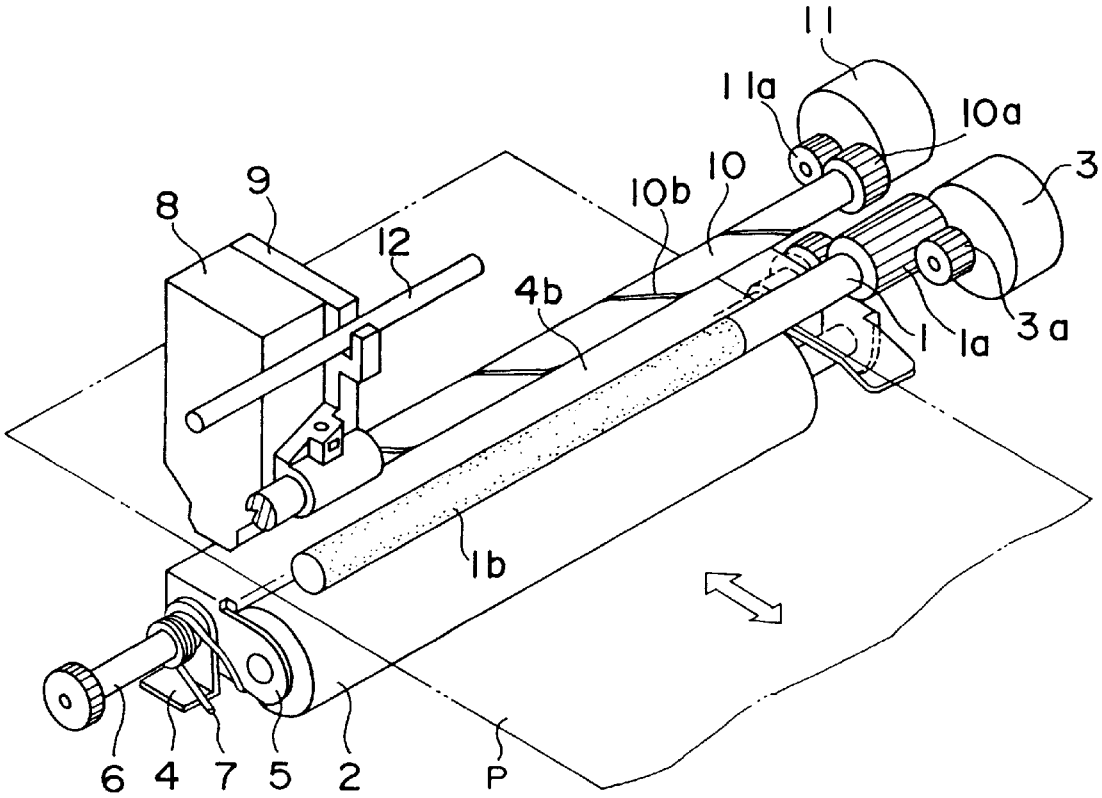
FIG. 1 is a perspective view showing an ink jet recording apparatus according to a first embodiment of the present invention.
Figure 2:
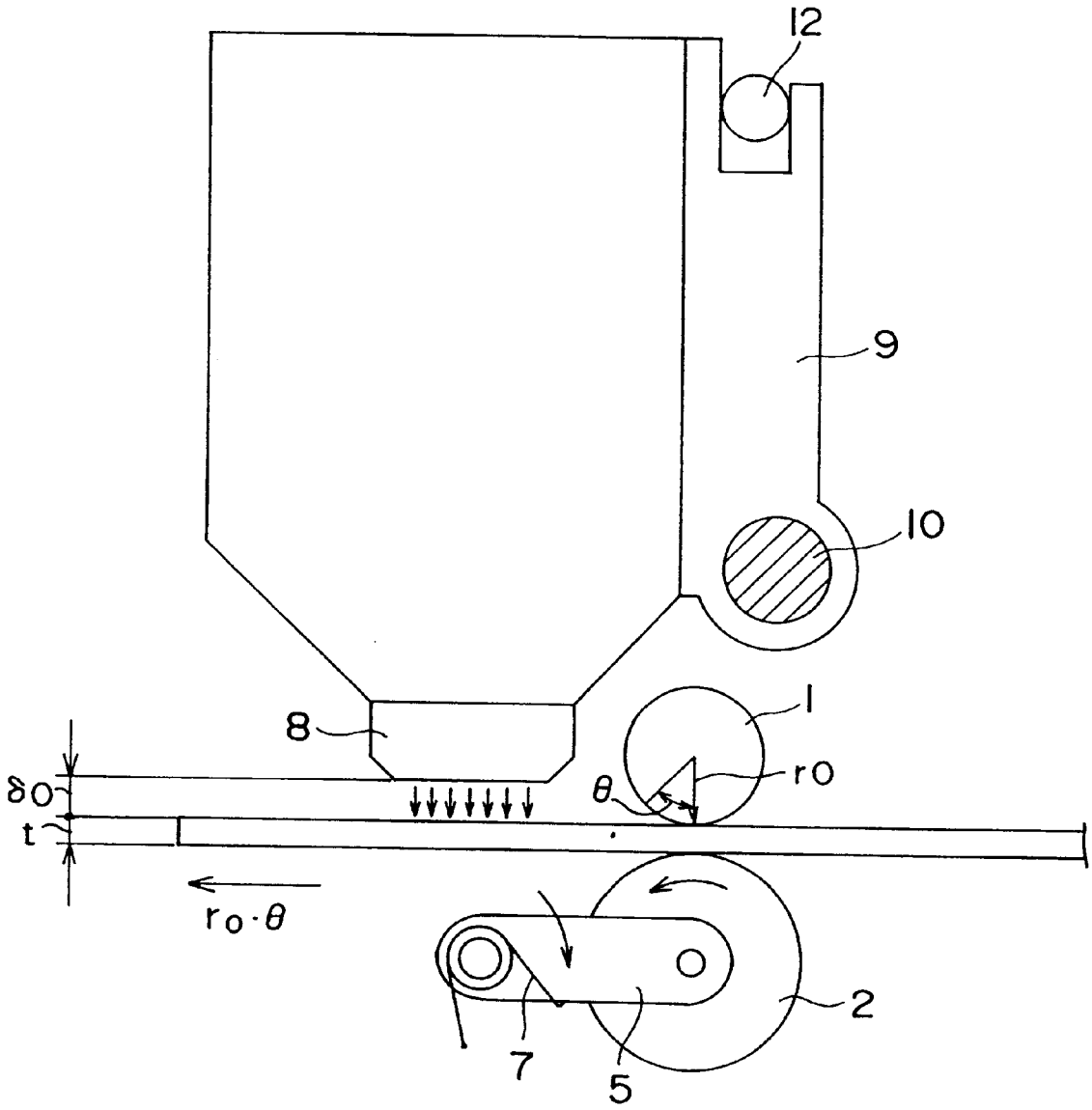
FIG. 2 is a side view of FIG. 1.

The first embodiment is an ink jet recording apparatus that employs an ink jet recording system. FIG. 1 is a perspective view showing the ink jet recording apparatus. FIG. 2 is a side view showing the ink jet recording apparatus.

With reference to FIGS. 1 and 2, the construction of the ink jet recording apparatus according to the first embodiment will be described section by section.

(Conveying Means)

In FIGS. 1 and 2, reference numerals 1 and 2 are a conveying roller and a pinch roller, respectively. The conveying roller 1 is pivoted to a frame of a main body of the apparatus through a bearing. Thus, the position of the conveying roller 1 is fixed. A gear 1*a* is disposed at an edge portion of the conveying roller 1. The gear 1*a* is engaged with a motor gear 3*a* connected to a conveying motor 3. By driving the rotation of the conveying motor 3, the rotating force thereof is transmitted to the conveying roller 1 through the gears 3*a* and 1*a*. The conveying roller 1 is a metal roller with rigidity. The conveying roller 1 is made of for example stainless steel. A peripheral surface 1*b* of the conveying roller 1 is stain-finished by for example a honing method so that the record paper sheet can be smoothly conveyed by the conveying roller 1.

Both edges of the pinch roller 2 are rotatably supported by an arm 5. The arm 5 extends from an arm support table 4. Thus, the pinch roller 2 presses the conveying roller 1. The arm support table 4 also works as a platen 4*b* that supports the record paper sheet P at a record position. A support shaft 6 is disposed at the arm support table 4. A twisted coil spring 7 is fitted to the support shaft 6. One end of the twisted coil spring 7 is secured to the arm 5. Thus, when the support shaft 6 is rotated in a predetermined direction as a rotation shaft, the pinch roller 2 is pressed to the conveying roller 1 through the arms 5. The pinch roller 2 is constructed of a rotation shaft and an elastic member covered therearound. The elastic member is made of a material that has high frictional characteristics such as hard rubber.

(Record Means)

Reference numeral 8 is a record head. The record head 8 records an ink image on the record paper sheet P conveyed by the conveying roller 1 and the pinch roller 2. In this apparatus, as a record means, there is employed an ink jet recording system with a record head that sprays ink to the record paper sheet P. The record head comprises a fine liquid spray orifice, a liquid passageway, an energy applying portion, and an energy generation means. The energy applying portion is disposed in the middle of the liquid passageway. The energy generation means generates liquid particle forming energy applied to the liquid at the energy applying portion.

The record head 8 is disposed downstream (in the conveying direction of the sheet) of the conveying roller 1 and the pinch roller 2. The record head 8 is opposed to the arm support table 4. The record head 8 is disposed on the carriage 9. The carriage 9 is connected to a lead screw 10. A screw gear 10*a* is disposed at an edge portion of the lead screw 10. The screw gear 10*a* is engaged with a motor gear 11*a*. The motor gear 11*a* is connected to a screw motor 11. Rotation force of the screw motor 11 is transmitted to the lead screw 10 through the gears 11*a* and 10*a*.

A pin (not shown) extends from the carriage 9. The pin is fitted to a screw groove 10*b* formed on a peripheral surface of the lead screw 10. Thus, when the lead screw 10 is rotated by the screw motor 11, the carriage 9 is axially reciprocated along the guide shaft 12. The record head 8 discharges ink in synchronization with the reciprocal operation of the carriage 9 so as to record information on the record paper sheet P.

FIG. 2 is a side view showing the conveying means and the record means of the recording apparatus of FIG. 1. In the first embodiment, since the conveying roller 1 is a follower metal roller disposed on a fixed side, a conveying amount of the record paper sheet P by the conveying roller 1 is given by:

$$L=r_0\cdot\theta$$

where L is the conveying amount L of the record paper sheet P by the conveying roller; $\delta_0$ is the distance between the record head 8 and the front surface of the record paper sheet P; t is the thickness of the record paper sheet P; $r_0$ is the radius of the conveying roller 1; and $\theta$ is the rotation angle. Thus, the conveying amount L becomes constant regardless of the sheet thickness t. In addition, the distance (record head distance) $\delta_0$ between the record head 8 and the front surface of the record paper sheet P becomes constant regardless of the sheet thickness t.

According to such a construction, the conveying amount of the record paper sheet by the conveying means and the recording distance by the record means can be kept constant regardless of the sheet thickness. Thus, an image can be recorded with constant line pitch and ink discharge distance regardless of the type of the record paper sheet, thereby improving image quality. It should be noted that the peripheral surface of the conveying roller 1 may be coated with an elastic material and the pinch roller 2 may be made of a resin material. In this case, frictional force between the conveying roller 1 and the record paper sheet P can be improved, thereby providing a more secure sheet conveying force.

In the above-mentioned embodiment, an ink jet recording system is used as a record means. However, the following construction is more preferably used. In this construction, an electro-thermal converting element is energized corresponding to a record signal. With thermal energy generated by the electro-thermal converting element, bubbles of ink generated by membrane boiling method are grown and shrunk so as to spray the ink through an ink spray orifice.

Figure 3:
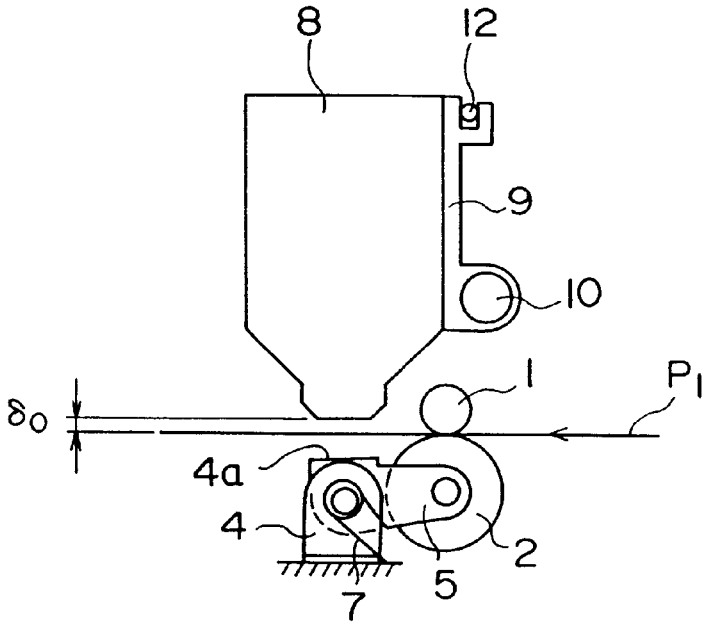
FIG. 3 is a side view of FIG. 1.
Figure 4:
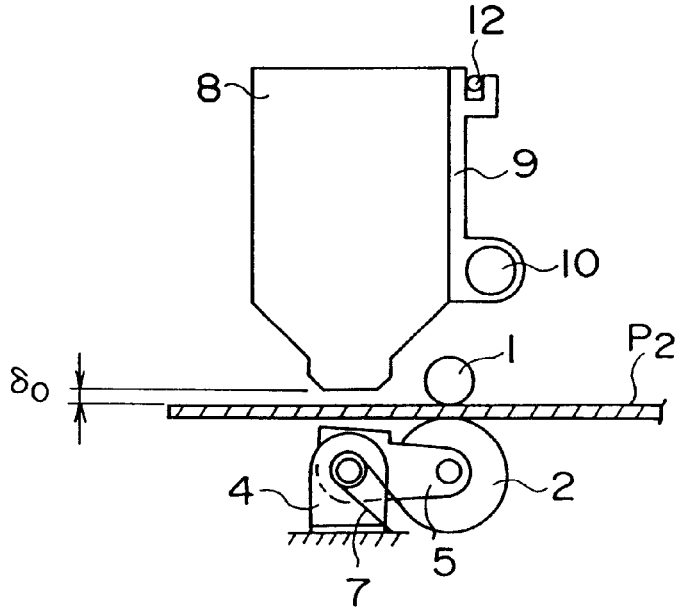
FIG. 4 is a side view of FIG. 1.

FIG. 3 is a sectional view showing the recording apparatus, which is conveying a thin paper sheet P1 and recording an image on it. On the other hand, FIG. 4 is a sectional view showing the recording apparatus, which is conveying a thick paper sheet P2 and recording an image on it.

In these drawings, the center position of the rotation of the conveying roller 1, which is opposed to the record head 8, is fixed. The pinch roller 2 presses the paper sheet P1 or P2 to the conveying roller 1 corresponding to the thickness thereof. The distance $\delta_0$ between the record head 8 and the paper sheet P1 or P2 is kept constant regardless of the thickness thereof.

In this recording apparatus, the carriage 9 is reciprocated so as to record an image with a predetermined length in the conveying direction on the paper sheet P1 or P2 that is being fixed. After the image has been recorded on the paper sheet P1 or P2, it is conveyed by the conveying roller 1 for a predetermined length (image length) and then fixed. By repeating these image recording steps, an image is formed on the entire surface of the paper sheet P1 or P2. In other embodiments that will be described later, an image is recorded in the same manner.

(Second Embodiment)

Figure 5:
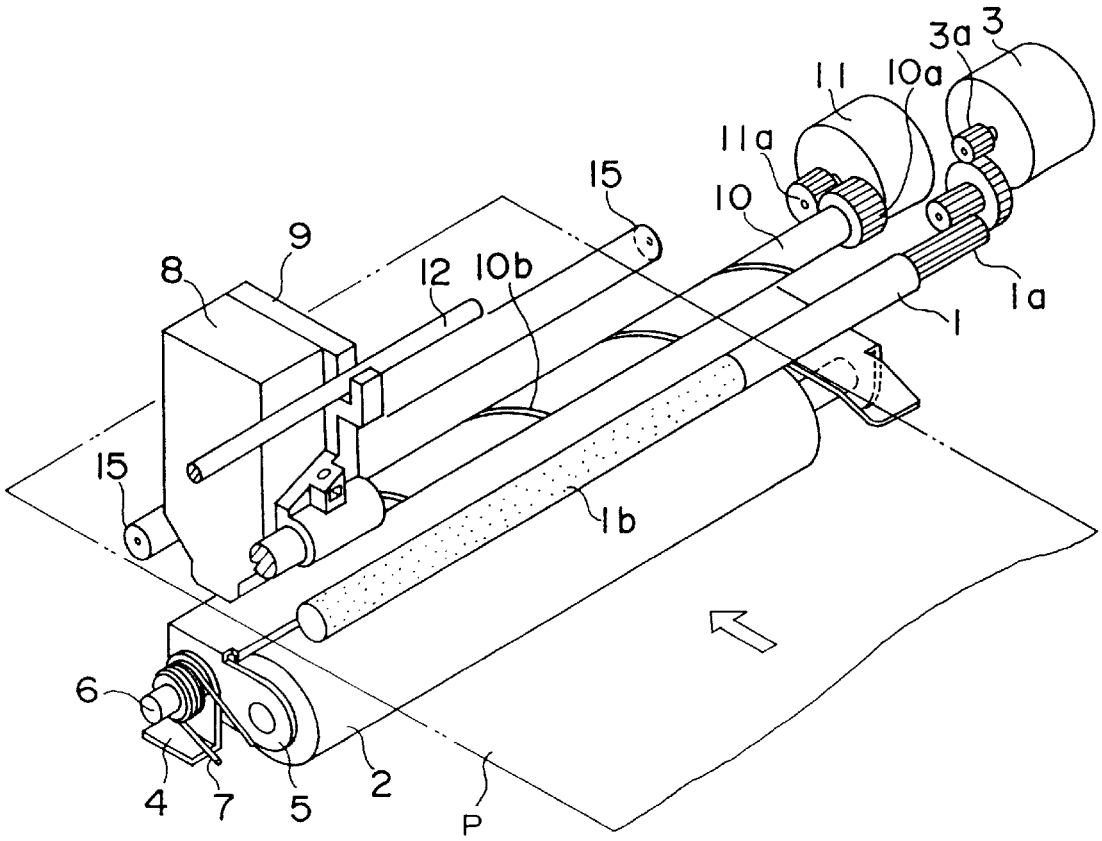
FIG. 5 is a perspective view showing an ink jet recording apparatus according to a second embodiment of the present invention.
Figure 6:
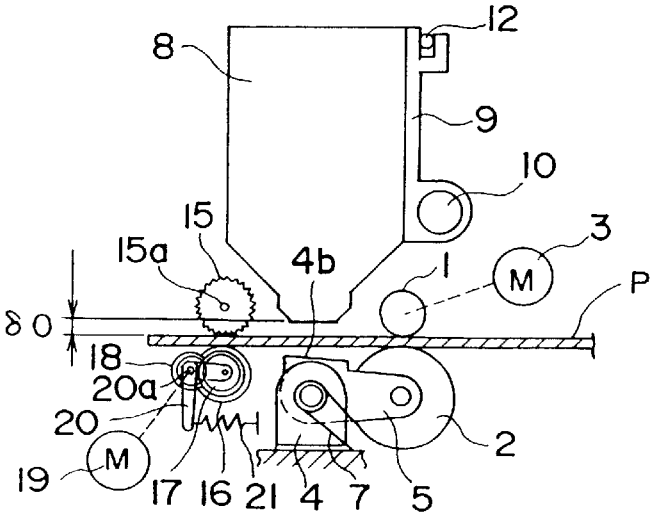
FIG. 6 is a side view of FIG. 5.

FIGS. 5 and 6 show a recording apparatus according to a second embodiment of the present invention. For the simplicity, in FIGS. 5 and 6, the same portions as FIGS. 1 to 4 are denoted by the same reference numerals and their description is omitted.

In the second embodiment, a pair of conveying rollers 15 and 16 are disposed downstream of a record head 8. The conveying rollers 15 and 16 work as a discharge means. After an image has been recorded on a record paper sheet P, it is unloaded outside the apparatus by the conveying rollers 15 and 16. The conveying roller 15 has radial sharp protrusions. In other words, the conveying roller 15 is a spur-shaped roller. Hereinafter, the conveying roller 15 is referred to as the spur roller 15. The spur roller 15 is rotated by the conveying roller 16 in such a way that the edges of the protrusions of the spur roller 15 are in contact with the record paper sheet P. Since the area that the spur roller 15 is in contact with the record paper sheet P is small, the amount of non-fixed ink that is transferred from the record paper sheet P to the spur roller 15 is small. Thus, the record paper sheet P is scarcely stained by the ink transferred to the spur roller 15.

Reference numeral 16 identifies a conveying roller. While pressing the record paper sheet P to the spur roller 15, the conveying roller 16 conveys the record paper sheet P. The conveying roller 16 is rotated by a motor 19. Reference numeral 17 is a gear with a rotation shaft that works in common with the conveying roller 16. Thus, the gear 17 is rotated along with the conveying roller 16. The gear 17 is engaged with a gear 18. The gear 18 is rotated by the motor 19 through a drive transmission mechanism such as a belt or a gear train. Reference numeral 20 is a bell crank that rotatably pivots the conveying roller 16 and the gear 17. The bell crank 20 is oscillationally supported by a shaft 20*a*. Reference numeral 21 is a tension spring. One end of the tension spring 21 is connected to the bell crank 20. The other end of the tension spring 21 is connected to the frame of the main body of the apparatus. As shown in FIG. 6, the bell crank 20 is biased counterclockwise. The conveying roller 16 is biased by the tension spring 21 so that the conveying roller 16 is pressed to the spur roller 15 through the record paper sheet P.

A rotation shaft 15*a* of the spur roller 15 is rotatably pivoted by the frame of the main body. The position of the rotation shaft 15*a,* namely the position of the spur roller 15, is fixed. On the other hand, the conveying roller 16 is movable corresponding to the thickness of the record paper sheet P.

Since the positions of the conveying roller 1 and the spur roller 15, which are in contact with the record paper sheet P, are fixed, the distance $\delta_0$ between the record head 8 and the record paper sheet P is always kept constant regardless of the thickness of the record paper sheet P.

The outer peripheral speed of the conveying roller 16 is faster than the peripheral speed of the conveying roller 1. In addition, the conveying roller 1 has frictional characteristics where the record paper sheet P slips off from the peripheral surface of the conveying roller 1. Thus, the conveying speed of the record paper sheet P depends on the peripheral speed of the conveying roller 1*b*. Since the record paper sheet P is tensioned by the conveying roller 16, the record paper sheet P is plainly kept by the conveyer rollers 1 and 16. At this point, the record paper sheet P is not in contact with a platen portion 4*b* of the support table 4.

Thus, the conveying amount of record material of the conveying means and the recording head distance of the record means can be kept constant regardless of the thickness of the record material. Consequently, since an image is recorded with a constant line pitch and a constant ink spray distance regardless of the type of the record material, a high image quality can be accomplished.

(Third Embodiment)

Next, a third embodiment of the present invention will be described.

Figure 7:
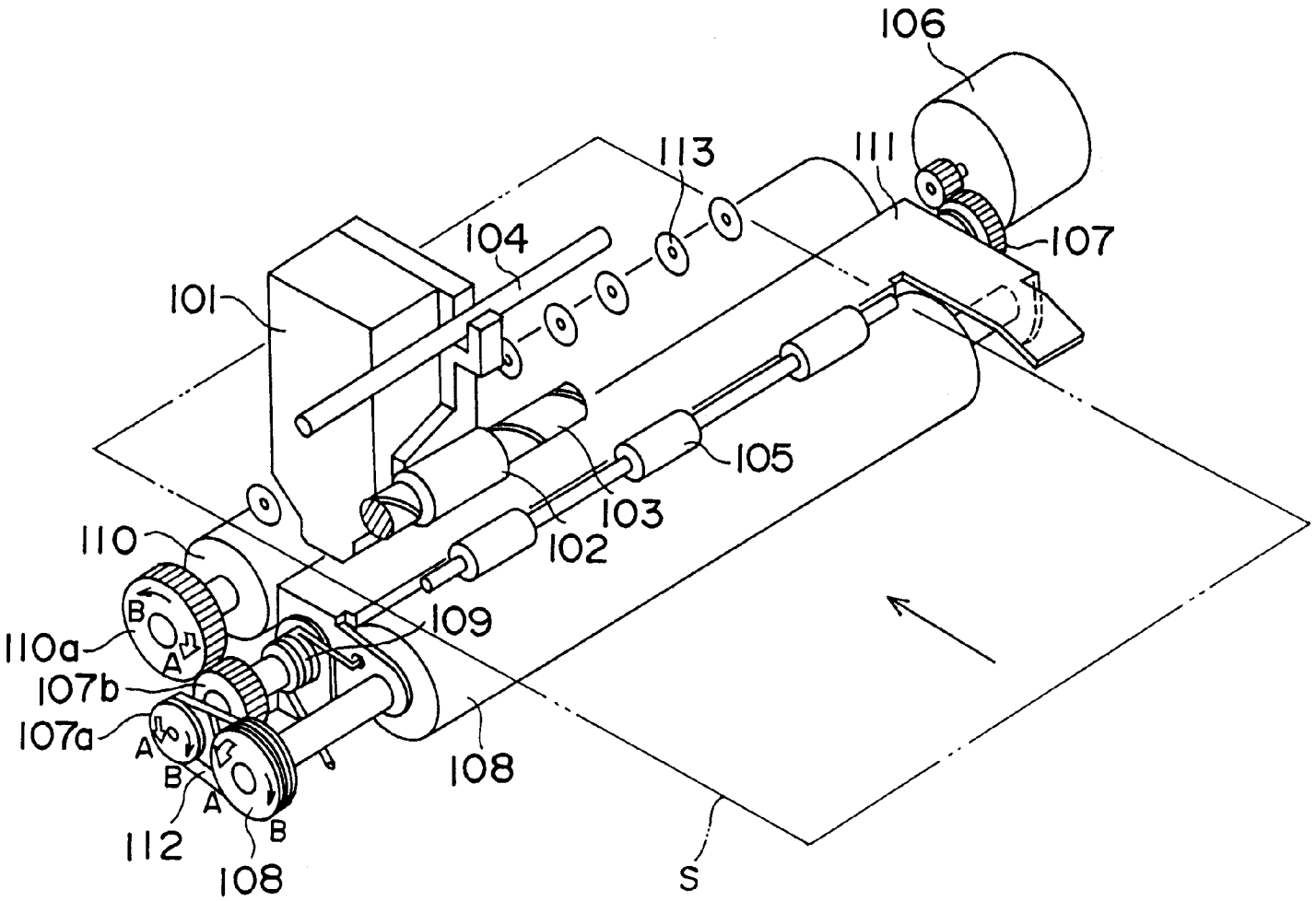
FIG. 7 is a perspective view showing an ink jet recording apparatus according to a third embodiment of the present invention.

FIG. 7 is a perspective view showing an ink jet recording apparatus according to the third embodiment of the present invention.

In FIG. 7, reference numeral 101 is an ink head. The ink head 101 is disposed on a carrier 102. The ink head 101 is moved horizontally by a carrier guide 104 and a lead screw 103. Reference numeral 106 is a paper feed motor. The paper feed motor 106 rotates a paper unload roller 110 and a power feed roller 108 so that their rotations are reverse to each other. The paper unload roller 110 is rotated through a drive shaft 107 and a gear 107*b*. On the other hand, the paper feed roller 108 is rotated through a pulley 107*a*.

When the rollers are rotated in direction denoted by arrow A, a leading edge of a paper sheet S is fed to the paper unload roller 110 by a pinch roller 105 and a paper feed roller 108. Since the paper unload roller 110 is rotated in the reverse direction of the paper feed roller 108, even if the paper sheet S is skewed, the entire leading edge of the paper sheet S is in contact with the paper unload roller 110. Thus, the paper sheet S is prevented from being skewed. Thereafter, when the paper feed motor 106 is reversely rotated, the paper sheet S is fed by a spur roller 113 and the paper unload roller 110. At this point, the paper feed roller 108 is reversely rotated. A belt 112 is slipped off and the pinch roller 105 is tensioned by a spring 109 with a supporting point of the drive shaft 107 and an angle of relief of an arm 111. Thus, the paper feed roller 108 is rotated so that the paper sheet S is tensioned with a weaker rotation torque than the paper unload roller 110. Since the paper sheet S is fed without loosening, the distance between the ink head 101 and the paper sheet S is kept constant, thereby improving the printing accuracy.

(Fourth Embodiment)

Figure 8:
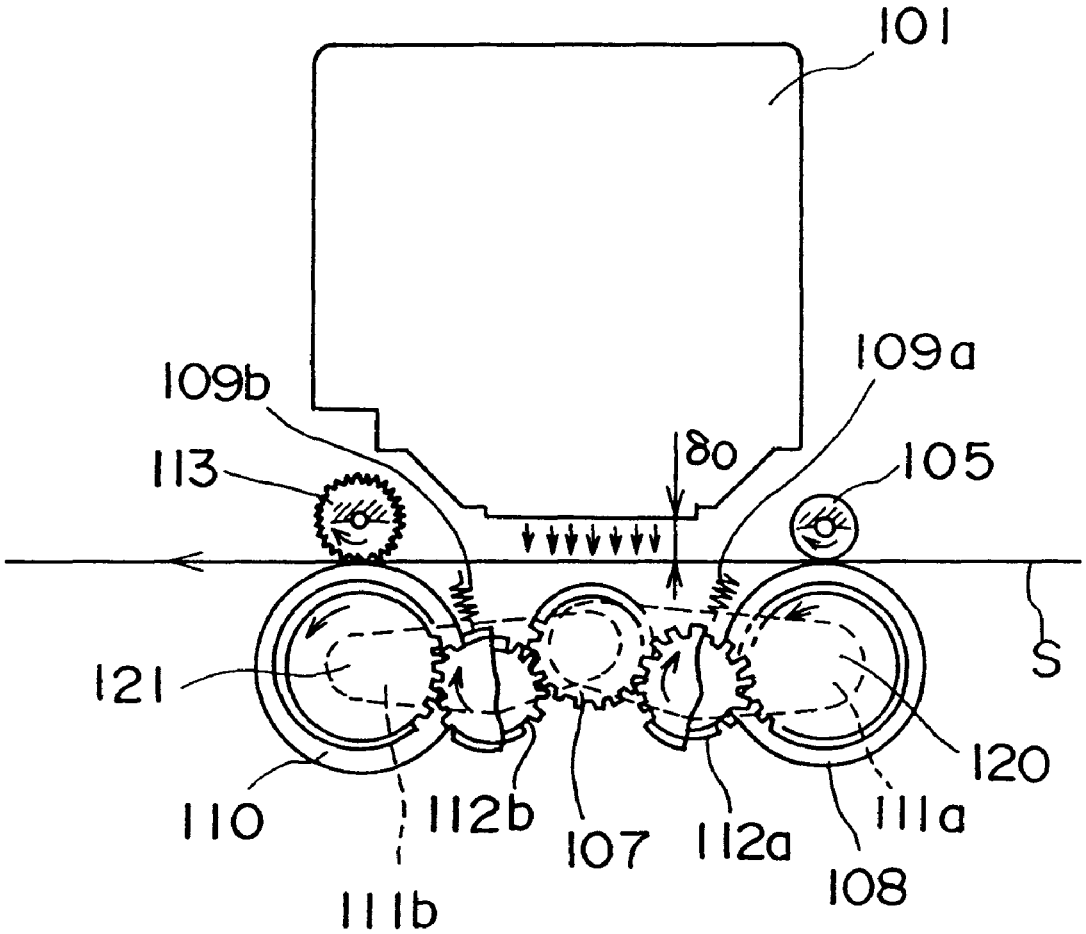
FIG. 8 is a side view showing an ink jet recording apparatus according to a fourth embodiment of the present invention.

FIG. 8 is a side view showing a recording apparatus according to a fourth embodiment of the present invention. In FIG. 8, a paper unload roller 110 is rotated by a drive gear 107 through a speed increasing gear 111*b*. A paper feed roller 108 is rotated through a speed decreasing gear 111*a* in the same direction as the paper unload roller 110. The speed of the paper feed roller 108 is lower than the speed of the paper unload roller 110. Reference numerals 109*a* and 109*b* are tension springs. The tension of the tension spring 109*a* is lower than the tension of the tension spring 109*b*. The paper feed roller 108 works as a tension roller. Thus, the pinch roller 105 and the paper feed roller 108 are tensioned and the paper unload roller 110 and the spur roller 113 are tensioned. Consequently, the sheet does not get loose, thereby improving recording accuracy.

Reference numeral 112*a* is an idler gear. The idler gear 112*a* is engaged with the drive gear 107 and the speed reducing gear 111*a* so as to transmit drive force. Reference numeral 112*b* is an idler gear that transmits drive force of the drive gear 107 to a speed increasing gear 111*b*. Reference numeral 120 is an oscillation arm that is oscillationally pivoted to a rotation shaft of the drive gear 107. The paper feed roller 108 and the speed reducing gear 111*a* are rotatably supported at an oscillation end of the oscillation arm 120. Reference numeral 121 is an oscillation arm that is oscillationally pivoted to the rotation shaft of the drive gear 107. The paper unload roller 110 and the speed increasing gear 111*b* are rotatably supported at an oscillation end of the oscillation arm 121.

Reference numeral 109*a* is a tension spring. One end of the tension spring 109*a* is connected to the oscillation arm 120. The other end of the tension spring 109*a* is connected to a frame of a main body of the apparatus so that the paper feed roller 108 is tensioned to the pinch roller 105. Likewise, reference numeral 109*b* is a tension spring. One end of the tension spring 109*b* is connected to the oscillation arm 121. The other end of the tension spring 109*b* is connected to the frame of the main body so that the paper unload roller 110 is tensioned to the pinch roller 113.

The pinch rollers 105 and 113 are rotatably pivoted to the frame of the main body of the apparatus. The positions of the pinch rollers 105 and 113 are fixed. When a thick sheet is conveyed, the paper feed roller 108 and the paper unload roller 110 are placed in their far positions where they are spaced most apart from the pinch rollers 105 and 113. Thus, the distance $\delta_0$ between the front surface of the sheet and the record head is always kept constant.

In the third embodiment featured in FIG. 7, instead of the belt 112, idler that slidably rotates may be used. A one-way clutch may be disposed between the pulley 107*a* and the gear 7*b*. In this case, when the leading edge of the paper sheet S is fed, the paper feed roller 108 may be rotated with strong force. When the paper feed roller 108 is used as a tension roller, it may be rotated with weak force. Thus, the same effect as the third embodiment may be obtained.

Thus, while ink jet record operation is performed, the record material is held without loosening. Consequently, the distance between the ink head and the record material is kept constant. As a result, since the record material is not in contact with the ink head, print quality is improved. When the record material is fed, a roller of the feeding portion is rotated in the reverse direction of a roller of the unload portion. Thus, even if the record material to be fed is skewed, the leading edge of the record material is adjusted at the roller position of the unload portion. Consequently, the ink jet record operation can be stably performed.

(Fifth Embodiment)

Figure 9:
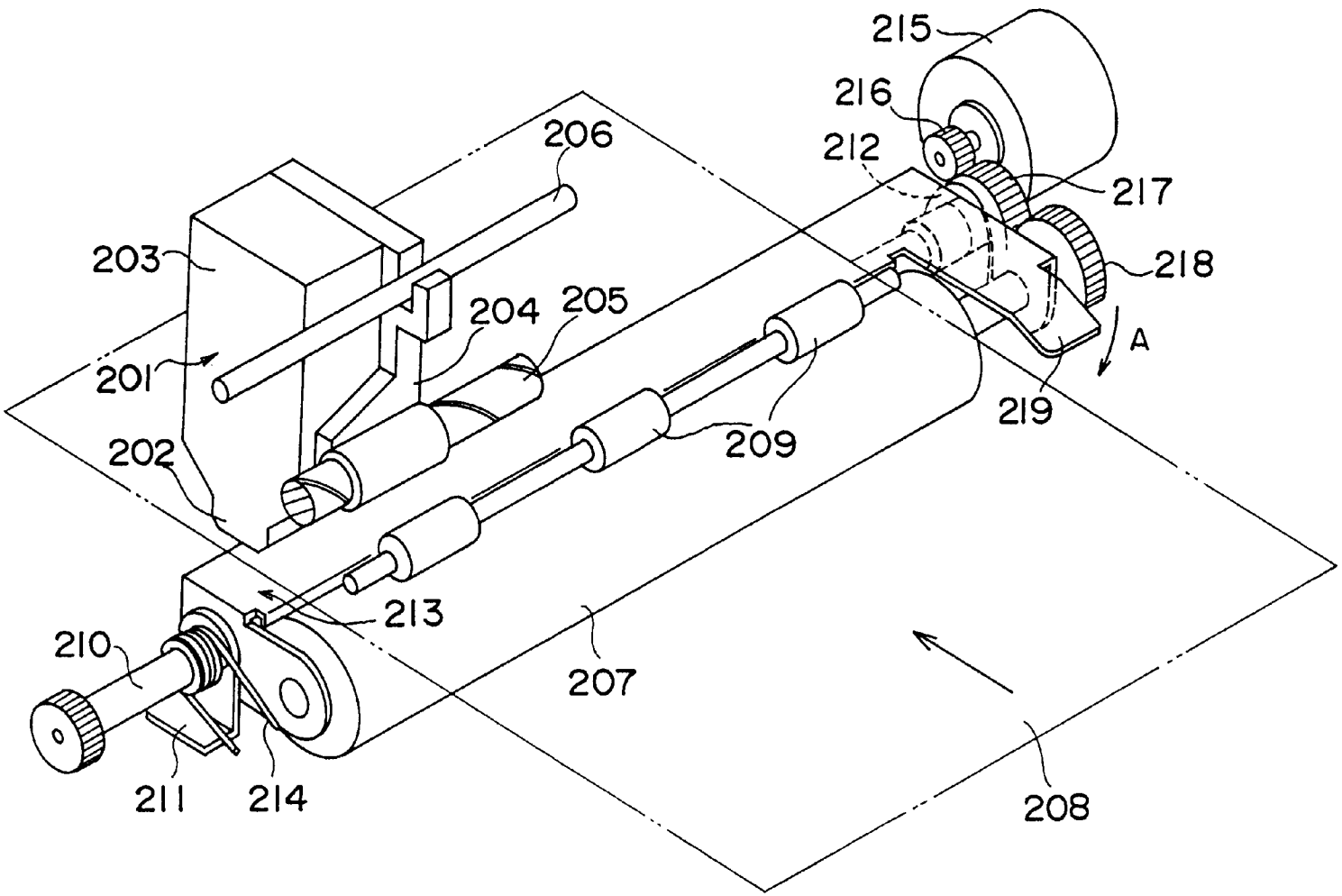
FIG. 9 is a schematic perspective view showing a recording apparatus according to a fifth embodiment of the present invention.

Next, with reference to FIG. 9, a fifth embodiment of the present invention will be described. In FIG. 9, reference numeral 201 is a detachable head cartridge where a record head (record means) 202 is incorporated with an ink tank 203. Reference numeral 204 is a carriage that holds the head cartridge 201. Reference numeral 205 is a guide shaft that reciprocatingly guides and supports the carriage 204. Reference numeral 206 is a guide shaft that slides and guides the carriage 204 in corporation with the guide shaft 205.

Reference numeral 207 is a paper feed roller (conveying roller) that conveys a record material 208 such as a record paper sheet. Reference numeral 209 is a pinch roller that presses the paper feed roller 207 through the record material 208 so as to produce frictional conveying force. Reference numeral 210 is a drive shaft disposed in parallel with the paper feed roller 207. The drive shaft 210 is pivoted to a main body of the apparatus through drive shaft brackets 211 and 212. The drive shaft brackets 211 and 212 are disposed on both ends of the drive shaft 210. Both edge portions of the paper feed roller 207 are rotatably pivoted by a support bracket 213. The support bracket 213 is rotatably supported about the drive shaft 210 that works as a supporting point.

The pinch roller 209 is rotatably supported at a fixed position of the main body of the apparatus. The support bracket 213 is biased to the pinch roller 209 by a torsion spring 214. The torsion spring 214 is disposed on one side of the support bracket 213. The rotation of the paper feed motor 207 is transmitted to the shaft of the paper feed roller through gears 216, 217, and 218 so as to drive the rotation of the paper feed roller 207.

A lever portion 219 is formed on one side (right side in this drawing) of the support bracket 213. The lever portion 219 releases the paper feed roller 207 from the pinch roller 209. By pushing down the lever portion 219 in direction denoted by arrow A, the support bracket 213 is rotated in the direction denoted by arrow A. Thus, the paper feed roller 207 is separated from the pinch roller 209 against the torsion spring 214.

The record head 202 (head cartridge 1) is provided with an electro-thermal converting element that generates thermal energy that is used to spray ink. In reality, ink is discharged from an ink spray opening corresponding to an ink status change (for example, generation of bubbles due to membrane boiling of ink by thermal energy).

Figure 10:
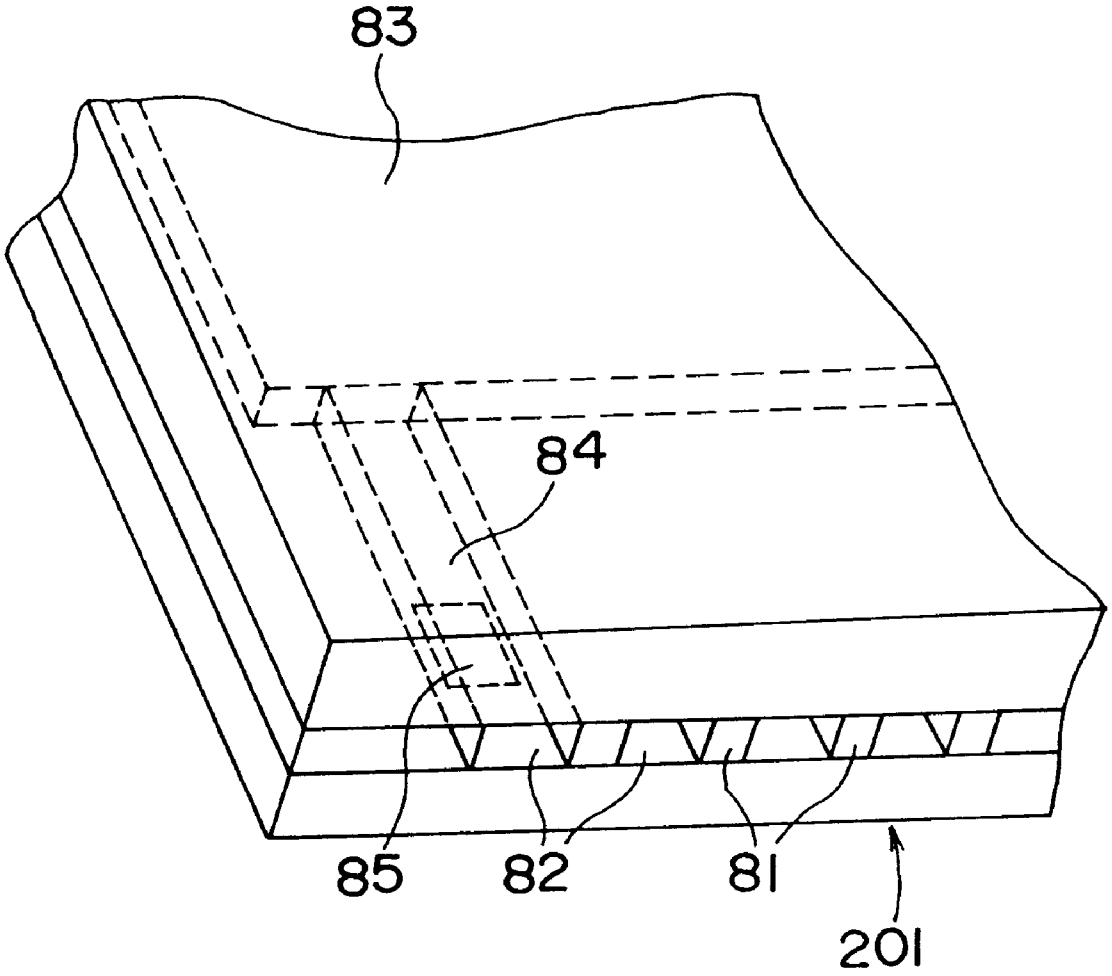
FIG. 10 is a partial perspective view showing a construction of an ink spray portion of a record means of FIG. 9.

FIG. 10 is a schematic partial perspective view showing a construction of an ink discharge portion of the record head 202. In FIG. 10, a plurality of ink discharge openings 82 are formed at predetermined pitches on a discharge surface 81 that is spaced apart from the record material by a predetermined distance (for example, 0.5 to 1.5 mm). Electric-thermal energy converting elements (heat generating resistor elements or the like) 85 that generate energy for spraying ink are disposed along a wall surface of each liquid passageway 84 that connects a common liquid chamber 83 and each ink discharge opening 82. In the recording apparatus shown in FIG. 7, the head cartridge 201 is disposed on the carriage 204 so that the ink discharge openings 82 are perpendicular to main scanning direction (moving direction) of the carriage 204. The electric-thermal energy converting elements 85 are driven (energized) corresponding to an image signal or a discharge signal. Ink in the corresponding liquid passageway 84 is membrane-boiled. There is an increase in pressure which causes the ink to be discharged from the corresponding ink discharge opening 82.

The record heads that are described in this specification has the same construction as FIG. 10.

According to the fifth embodiment, supporting members that support both edges of a paper feed roller 207 are incorporated as a support bracket 213. The support bracket 213 pivots both the edges portions of the paper feed roller 207. In addition, a release lever portion 219 is incorporated with one side of the support bracket 213. Thus, the paper feed roller 207 is immediately separated from the pinch roller 209. Consequently, a release operation can be securely performed. In addition, by pressing down the protruded lever portion 219 (namely, with a one touch operation), the paper feed roller 207 can be released. Moreover, no dedicated member for the release operation is required. Thus, the number of constructional members can be reduced, thereby lowering the cost. In addition, since a space for the dedicated member is not required, the size of the recording apparatus can be reduced.

In a recording apparatus that presses a pinch roller disposed on a movable shaft to a paper feed roller (conveying roller), support members disposed at both edges of the pinch roller are incorporated as a pinch roller support bracket. The pinch roller support bracket pivots both the edge portions of the pinch roller. In addition, a release lever portion may be disposed on the pinch roller support bracket. In the fifth embodiment, while the lever portion is being pushed down, release mode takes place. However, with a latch mechanism, the release mode may be continued.

Figure 11:
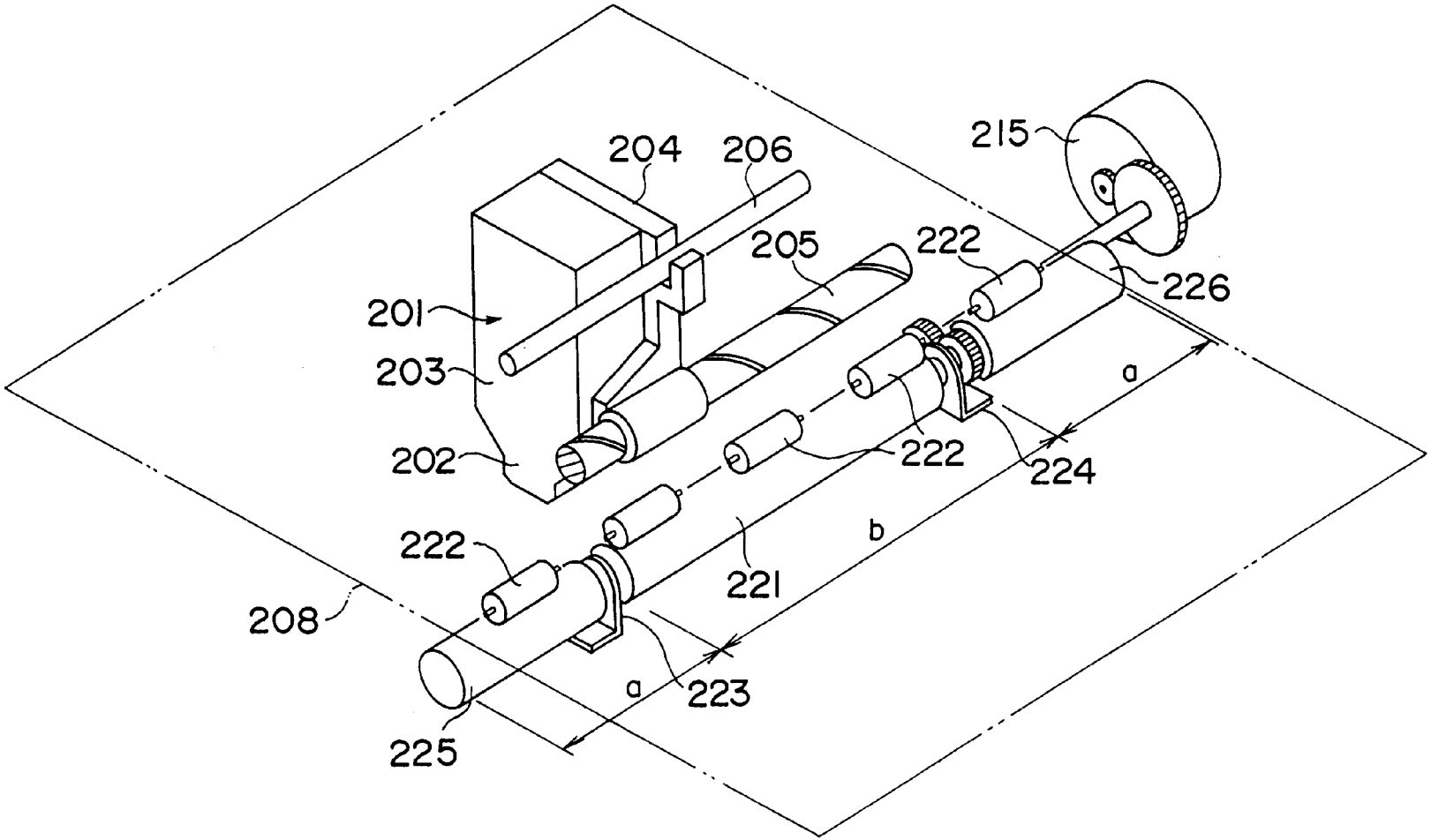
FIG. 11 is a schematic perspective view showing a recording apparatus according to a sixth embodiment of the present invention.

FIG. 11 is a schematic perspective view showing a paper feed mechanism of a recording apparatus according to a sixth embodiment of the present invention. In this embodiment, an extension roller portion is disposed outside bearings disposed at both end sides of a paper feed roller. The extension roller portion is coaxial to the paper feed roller. The paper feed roller and the extension roller portion are tensioned to a pinch roller so that the entire width of a record material is equally tensioned. In the sixth embodiment, the recording apparatus is an ink jet recording apparatus.

In FIG. 11, reference numeral 201 is a detachable head cartridge where a record head (record means) 202 is incorporated with an ink tank 203. Reference numeral 204 is a carriage that holds the head cartridge 201. Reference numeral 205 is a guide shaft that reciprocatingly guides and supports the carriage 204. Reference numeral 206 is a guide shaft that slides and guides the carriage 204 in cooperation with the guide shaft 205. Reference numeral 221 is a paper feed roller (conveying roller) that conveys a record material 208 such as a record paper sheet. Reference numeral 222 is a pinch roller that presses the paper feed roller 207 through the record material 208 so as to produce a frictional conveying force. Reference numeral 215 is a paper feed roller that drives the rotation of the paper feed roller 221.

Both edge portions of the paper feed roller 221 are rotatably pivoted by bearing brackets 223 and 224 disposed on the recording apparatus. Extension roller portions 225 and 226 are disposed outside the bearings 223 and 224 of the paper feed roller 221, respectively. The extension roller portions 225 and 226 rotated along with the roller 221. A plurality of pinch rollers 222 are coaxially disposed so as to press the paper feed roller 221 and the extension roller portions 225 and 226. The paper feed roller 221, the extension roller portions 225 and 226, and the pinch rollers 222 press the record material 208 so that the entire width thereof is equally pressed. More specifically, the bearing portions of the bearing brackets 223 and 224 disposed at both edges of the paper feed roller 221 nearly match Airy points of the paper feed roller 221 and the extension roller portions 225 and 226 on both the edges.

Figure 12:
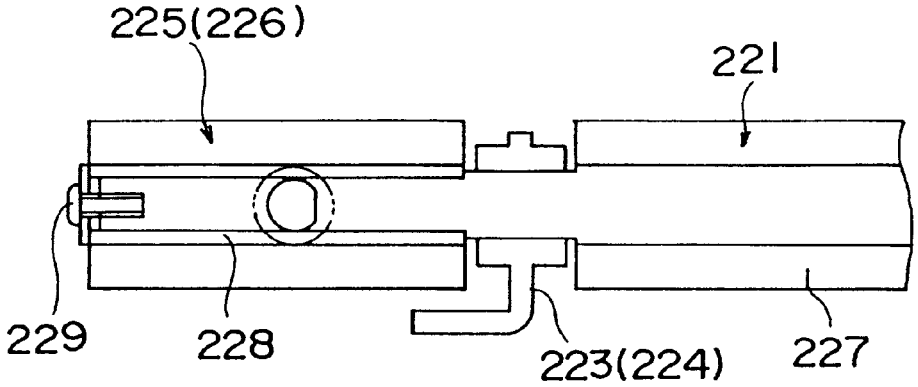
FIG. 12 is a schematic partial vertical sectional view showing an extension roller portion of a paper feed roller according to a first modification of the recording apparatus of FIG. 11.
Figure 13:
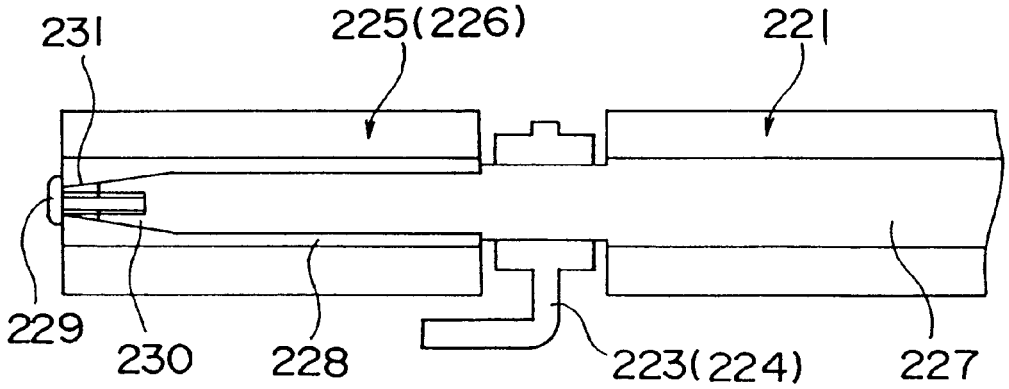
FIG. 13 is a schematic partial vertical sectional view showing an extension roller portion of a paper feed roller according to a second modification of the recording apparatus of FIG. 11.
Figure 14:
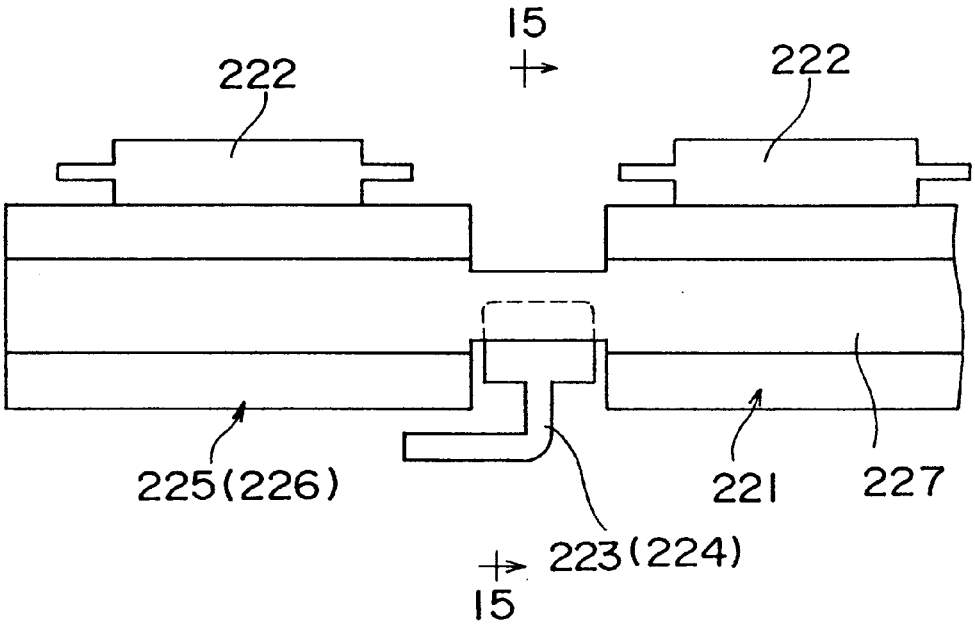
FIG. 14 is a schematic partial vertical sectional view showing an extension roller portion of a paper feed roller according to a third modification of the recording apparatus of FIG. 11.
Figure 15:
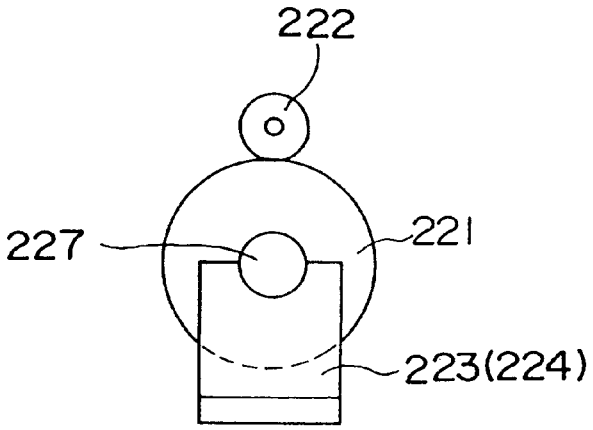
FIG. 15 is a sectional view taken along line 15—15 of FIG. 14.

FIGS. 12 to 14 are schematic partial vertical sectional views showing constructions of the paper feed roller 21 and the extension roller portion 25 of FIG. 11. FIG. 15 is a schematic sectional view taken along line 15—15 of FIG. 14. In FIGS. 12 to 14, an extension roller portion 223 disposed on one side of the paper feed roller 221 is shown. The construction of an extension roller portion 224 on the other side (right side) is substantially the same as the construction of the extension roller portion 223 on the left side. Thus, in these drawings, the extension roller portion 224 is denoted with parentheses.

In a first modification shown in FIG. 12, the sectional shape of the protrusion portion protruding from the bearing bracket 223 (224) of the shaft 227 of the paper feed roller 221 is denoted by a two-dashed line. In other words, the protrusion portion has one flat portion. The flat portion prevents the protrusion portion from rotating. In addition, a center hole of a core member 228 of the extension roller portion 225 (226) has one flat portion. The extension roller portions 225 and 226 are inserted and fitted into the protrusion portions on both the edges of the shaft 227 in such a way that they do not turn. With machine screws 229 and 229, the extension roller portions 225 and 226 are secured. Thus, the extension roller portions 225 and 226 are incorporated into the paper feed roller 221.

In a second modification shown in FIG. 13, taper portions 230 are formed at protrusion portions on both edges of the shaft 227 of the paper feed roller 221. In addition, taper hole portions 231 are formed at edge portions of core members 228 of the extension roller portions 225 and 226, respectively. The taper hole portions 231 are fitted into the taper portions 230, respectively. With machine screws 229, the taper portions 230 are secured to the taper hole portions 231, respectively. Thus, the extension roller portions 225 and 226 are incorporated into both edge portions of the paper feed roller 221. In a third modification shown in FIGS. 14 and 15, extension roller portions 225 and 226 are incorporatedly formed at both edges of a paper feed roller 221. With bearing brackets 223 and 224, a shaft 227 is pivoted on a load support side of a pinch roller 222.

In FIG. 11, a plurality of pinch rollers 222 are disposed at predetermined pitches on the same axis. At least one of these pinch roller 222 is tensioned to the paper feed roller 221, or the extension roller portions 225 and 226 in such a way that the entire width of the record material 208 to be conveyed is equally pressed (nearly equally loaded). Practically, as shown in FIG. 11, the extension roller portions 225, the paper feed roller 221, and the extension roller portion 226 are positioned so that Airy points of a:b:a are satisfied.

As is evident in FIG. 11, the Airy points correspond to the paired points set by the distance b for supporting the beam on which the full load is equally disturbed so that the strain of the beam is minimized.

In the first to third modification of the sixth embodiment shown in FIGS. 11 to 15, bearing portions 223 and 224 of a narrow and long sheet feed means constructed of a paper feed roller 221 and extension roller portions 225 and 226 are placed so that Airy points are satisfied. The tension of pinch rollers 222 is equally applied to the sheet feed means. Thus, the sheet feed means 221, 225, and 226 can be least bent, thereby providing a recording apparatus with high sheet feed accuracy.

(Seventh Embodiment)

Figure 16:
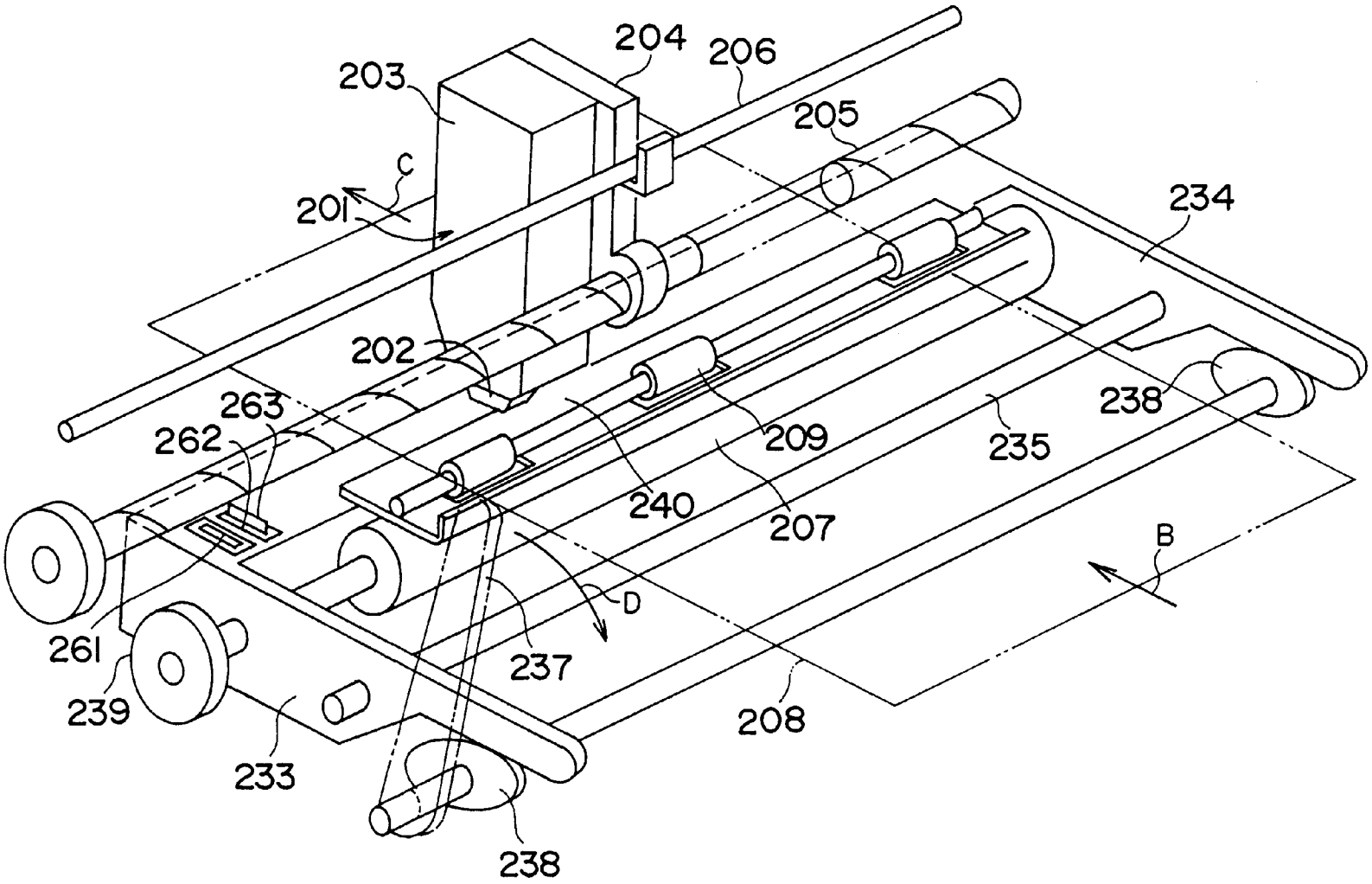
FIG. 16 is a schematic perspective view showing a recording apparatus according to a seventh embodiment of the present invention.

FIG. 16 is a schematic perspective view showing a paper feed mechanism of a recording apparatus according to a seventh embodiment of the present invention. In this embodiment, a record material guide member is disposed adjacent to and upstream (in a conveying direction) of a record means of the record material. At least a contact portion of the record material guide member that is in contact with the record material is bake-finished with a material that has water repelling characteristics, a small frictional coefficient against the record material, and high wearing resistance. In this embodiment, the recording apparatus is an ink jet recording apparatus.

In FIG. 16, reference numeral 201 is a detachable head cartridge where a record head (record means) 202 is incorporated with an ink tank 203. Reference numeral 204 is a carriage that holds the head cartridge 201. Reference numeral 205 is a guide shaft that reciprocatingly guides and supports the carriage 204. Reference numeral 206 is a guide shaft that slides and guides the carriage 204 in association with the guide shaft 205. Reference numeral 207 is a paper feed roller (conveying roller) that conveys a record material 208 such as a record paper sheet. Reference numeral 209 is a pinch roller that presses the paper feed roller 207 through the record material 208 so as to produce frictional conveying force.

In FIG. 16, the record material 208, which is a sheet of paper, a plastic sheet, or the like, is conveyed in direction denoted by arrow B by the paper feed roller 207 and the pinch roller 209. After the record head 202 has recorded an image on the record material 208, the record material 208 is discharged in the direction denoted by arrow C by a paper discharge roller or the like. The paper feed roller 207 is oscillationally supported about a shaft 235 that works as a supporting point through arm portions 233 and 234. The arm portions pivot both edge portions of the paper feed roller 207.

In FIG. 16, a cap member 261 is disposed at a home position of the record head 202. The cap member 261 is opposed to an ink discharge opening 81 of the record head 202. The cap member 261 is made of an air-tight elastic material such as rubber. The cap member 261 is moved by a drive means (not shown) so as to close or open the ink discharge opening 81. When an image is not recorded, the head cartridge 201 is moved to the home position. At this point, the cap member 261 is moved forward so as to airtightly close the ink discharge opening 82 of the record head 202. A wiping blade 263 is disposed adjacent to the cap member 261. The wiping blade 263 is disposed on the holder 262. The wiping blade 263 is made of an elastic member such as silicon rubber or urethane rubber. In synchronization with the motion of the carriage 204, the wiping blade 263 wipes out adhered substances (such as ink, paper fibers, and dust) from the ink spray orifice 81 of the record head 202.

Figure 17:
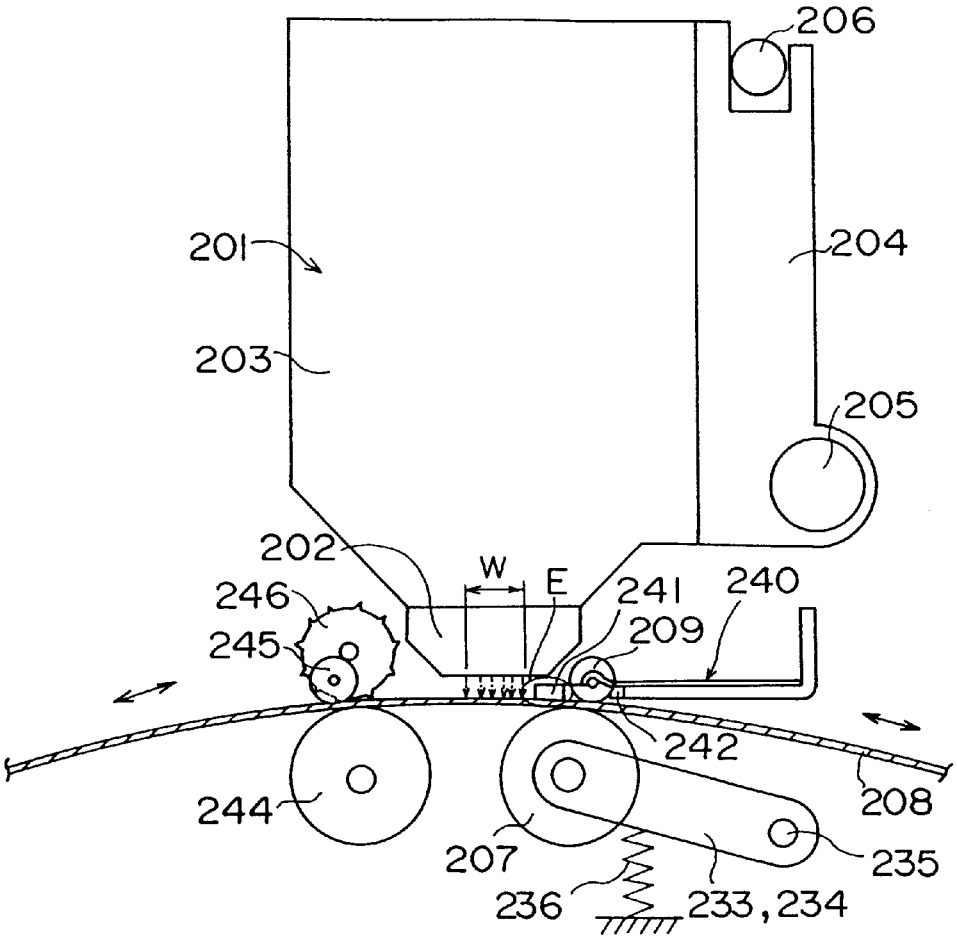
FIG. 17 is a vertical sectional view showing a paper feed direction of the recording apparatus of FIG. 16.

FIG. 17 is a vertical sectional view in a paper feed direction of the recording apparatus of FIG. 16. In FIGS. 17 and 16, arm portions 233 and 234 that pivot the paper feed roller 207 are oscillationally disposed about a shaft 235. The arm portions 233 and 234 are biased to the pinch roller 209 by a tension spring 236 (see FIG. 18). Thus, the paper feed roller 207 is biased to the pinch roller 209 on the fixed shaft.

In FIG. 16, forward edge portions of the arm portions 233 and 234 are brought into contact with release cams 238 and 238 that are rotated by a release lever 237, respectively. Thus, when the release lever 237 is rotated in the direction denoted by arrow D, the release cams 238 and 238 are rotated, thereby separating the paper feed roller 207 from the pinch rollers 209. A gear 239 is secured to one edge of the shaft portion of the paper feed roller 207. The paper feed roller 207 is rotated by a motor (not shown) through the gear 239. The carriage 204 is reciprocated by a carriage motor (not shown).

In FIGS. 16 and 17, a record material guide member 240 is disposed adjacent to and upstream (in the conveying direction of the record material 208) of the record head (record means) 202. The record material guide member 240 guides the record material 208 that is biased and pinched by the paper feed roller 207 and the pinch roller 209. When the forward edge portion (paper contact portion 241) of the record material guide member 240 is brought into contact with the record material 208, the record material 208 is guided along a predetermined conveying path. In this embodiment, an opening 242 is formed corresponding to each of the pinch rollers 209 of the record material guiding member 240. Each pinch roller 209 is pivoted by the record material guide member 240. In FIG. 17, a paper discharge system is disposed downstream (in the record paper sheet conveying direction) of the record head 202. The paper discharge system is constructed of a paper discharge roller 244 and pinch rollers 245. Alternatively, the paper discharge system is constructed of a paper discharge roller 244 and spurs 246.

Figure 18:
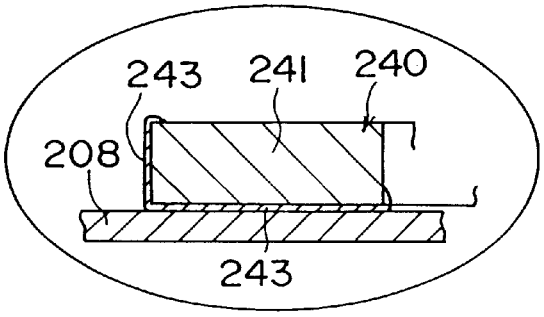
FIG. 18 is an enlarged view showing a portion denoted by an elongate circle E of FIG. 7.

FIG. 18 is an enlarged view showing portion E (an elongate circle) of FIG. 17. In FIGS. 17 and 18, a portion including the paper contact portion 241 of the record material guide member 240 is coated with an outer layer 243 that has water repelling characteristics, low frictional coefficient against the record material 208, and high wearing resistance. This outer layer 243 is formed by bake-finishing for example Teflon resin. In other words, the paper contact portion 241 of the record material guide member 240 and sheared and broken surfaces of the record material guide member 240 are coated with the outer layer 243, which is made of Teflon resin and has water repelling characteristics, low frictional coefficient, and high wearing resistance.

According to the seventh embodiment shown in FIGS. 16 to 18, since the sliding characteristic of a surface where the record material guide member 240 is in contact with the record material 208 is high, the record material can be quietly fed. In addition, the load of the paper feed motor can be reduced. Thus, damage to the record material 208 can be prevented. Since the record material guide member 40 is free from corroding, the guiding function is prevented from being lowered. Moreover, when the paper feed roller 207 is reversely rotated, ink on the record material 208 is not transferred to the record material guide member 240, the record material 208 and the record material guide member 240 can be prevented from being stained by the ink. Furthermore, since the record material 208 is neither twisted nor waved by the pinch rollers 209, the accuracies of the recording operation and the paper feed operation are improved.

The surface layer 243 may be formed by bake-finishing a lubricant containing molybdenum disulfide instead of Teflon resin. With this lubricant, the same effects may be obtained. In addition, the record material guide member 240 may be formed of engineering plastics containing Teflon or the like. As a modification of the outer layer 243, when Teflon resin or the like is bake-finished on metal rails that support the carriage 204, a carriage feed mechanism that has high sliding characteristics, low noise, and low motor load may be provided.

(Eighth Embodiment)

Figure 19:
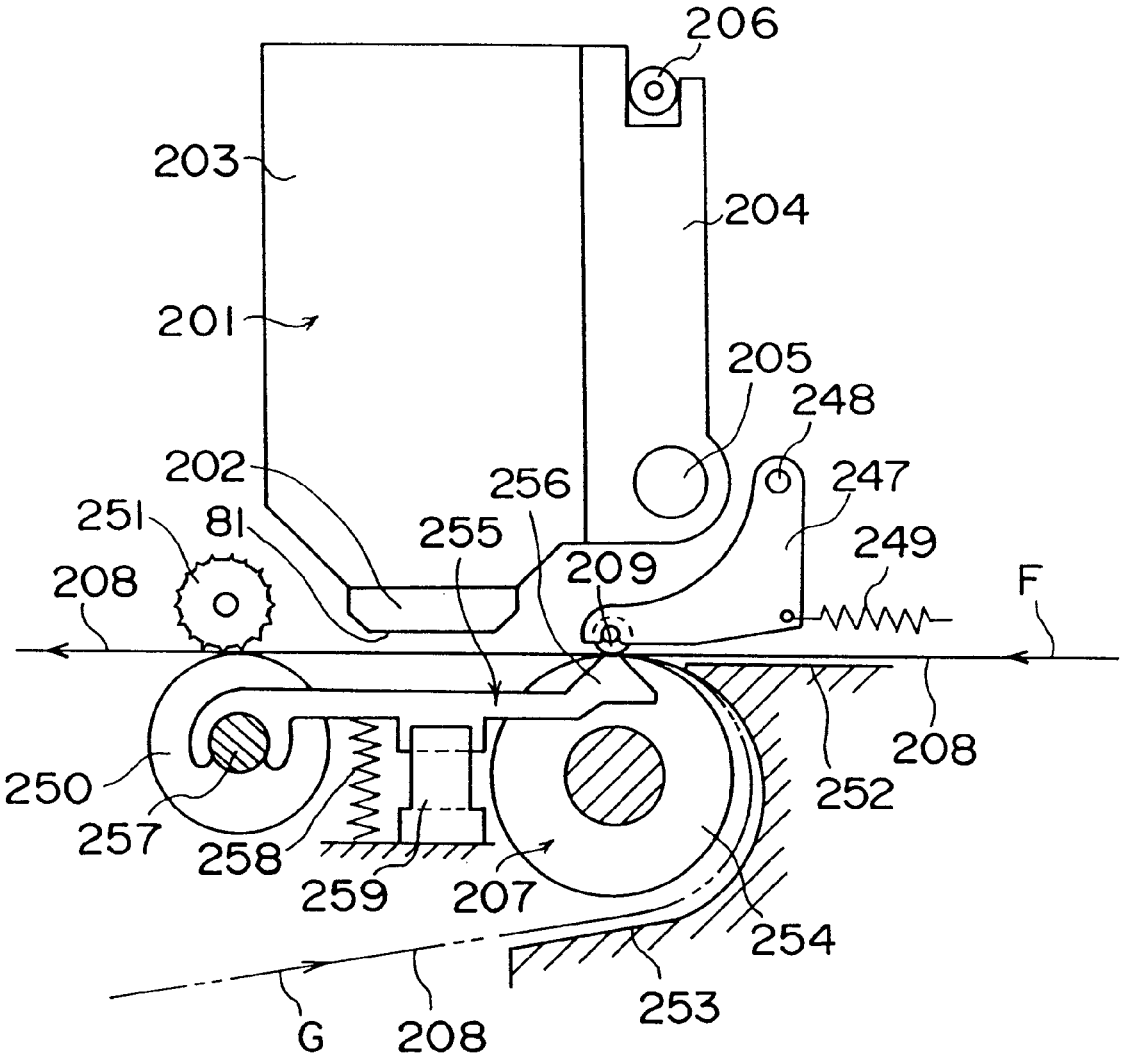
FIG. 19 is a vertical sectional view showing a recording apparatus according to an eighth embodiment of the present invention.
Figure 20:
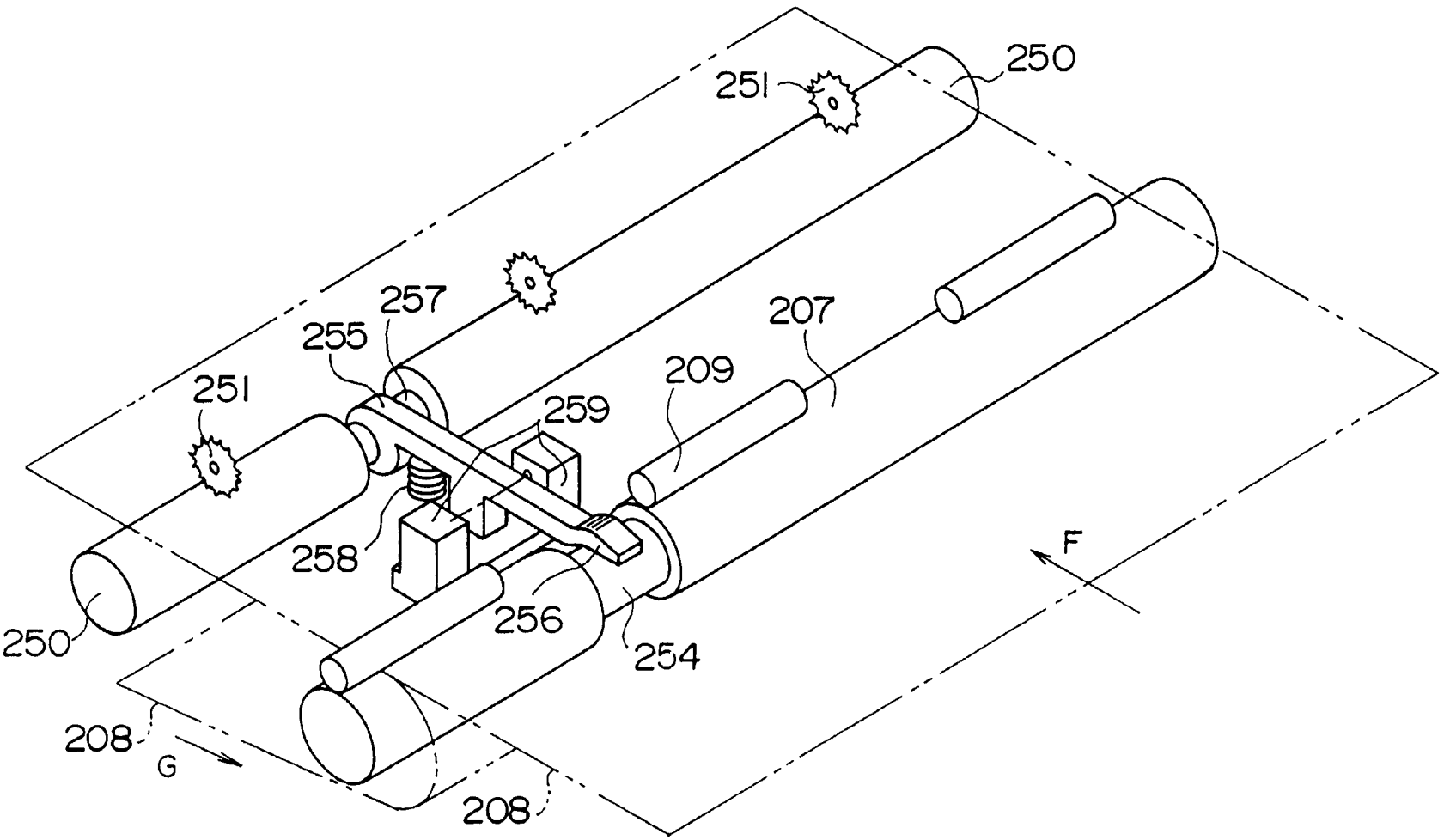
FIG. 20 is a schematic perspective view showing a paper feed mechanism of the recording apparatus of FIG. 19.

FIG. 19 is a schematic side view showing a paper feed mechanism of a recording apparatus according to an eighth embodiment of the present invention. FIG. 20 is a schematic partial perspective view of FIG. 19. In FIGS. 19 and 20, a paper feed roller has a groove portion that is disposed between pinch rollers. A paper contact portion of an actuator of a detector is disposed inside the groove portion. The detector detects whether a record material is present or not. Thus, in this embodiment, the record material is detected in a paper feed direction at a record material contact drive portion. In this embodiment, the recording apparatus is an ink jet recording apparatus.

In FIG. 19, reference numeral 201 is a detachable head cartridge where a record head (record means) 202 is incorporated with an ink tank 203. Reference numeral 204 is a carriage that reciprocatingly holds and moves the head cartridge 201. Reference numerals 205 and 206 are a pair of guide shafts that reciprocatingly guide and hold the carriage 204. In FIGS. 19 and 20, reference numeral 207 is a paper feed roller. Reference numeral 208 is a record material such as a record paper sheet. Reference numeral 209 is a pinch roller that is in contact with the paper feed roller 207.

In FIG. 19, reference numeral 247 is a pinch roller support bracket that pivots the pinch roller 209. Reference numeral 248 is a support shaft that oscillationally pivots the pinch roller support bracket 247. Reference numeral 249 is a pinch roller tension spring that presses the pinch roller 209 to the paper feed roller 207 through the pinch roller support bracket 247. In FIGS. 19 and 20, a paper feed system is disposed upstream (in a paper feed direction) of the record portion (opposed to the record head 202). The paper feed system is constructed of the paper feed roller 207 and the pinch roller 209. A paper discharge system is disposed downstream (in the paper feed driection) of the record portion. The paper discharge system is constructed of a paper discharge roller 250 and a spur 251. In this embodiment shown in the FIG. 19, the paper feed system (207 and 209) and the paper discharge system (250 and 251) are disposed relatively close to the record head 202.

In the recording apparatus shown in FIG. 19, the record material 208 can be fed from two directions denoted by arrows F and G (or from a plurality of directions). In other words, the recording apparatus has a first sheet guide 252 and a second sheet guide 253. The first sheet guide 252 ranges from a first paper insert portion (not shown) to the pinch roller 209 (record material pressing portion). The second sheet guide 253 ranges from a second paper insert portion (not shown) to the pinch roller 209. Thus, the record material 208 can be fed from the different directions denoted by arrows F and G.

In FIGS. 19 and 20, the paper feed roller 207 has a groove 254 with a predetermined width. The groove 254 is formed on an outer periphery of the paper feed roller 207 and perpendicular to an axial direction thereof. A sheet contact portion 256 of a detection lever 255 is disposed inside the groove 254. The detection lever 255 detects whether or not the record material 208 is present. The record material detector comprises the detection lever 255, a tension spring 258, and a non-contact type detector 259. The detection lever 255 is oscillationally moved about a shaft 257 (in this embodiment, the shaft of the paper unload roller 250). The tension spring 258 biases the detection lever 255 to the pinch roller 229, thereby pressing the sheet contact portion 256 to the pinch roller 209 through the record material 208. The detection portion 259 electrically detects the motion (displacement) of the detection lever 255. The detection portion is for example a photointerrupter.

In the eighth embodiment shown in FIGS. 19 and 20, the contact portion of the detection lever 255 and the record material 208 is placed at a pressing portion or pinch portion of the paper feed roller 207 and the pinch roller 209. Thus, the record material 208 is detected at the record material pressing drive portion in the paper feed direction. Thus, the following effects can be obtained. As a first effect, since the record material 208 is detected at the position of the record material pressing drive portion, regardless of whether the record material 208 is fed from the direction denoted by arrow F or G, the record material can be accurately detected. As a second effect, since the detection lever 255 is brought into contact with a pinch portion where the record material 208 is most strongly held, the record material 208 can be securely detected.

As a third effect, since the sheet detector is disposed between the paper feed roller 207 and the paper unload roller 250, the detection mechanism does not protrude. Thus, the recording apparatus can be compactly constructed. As a fourth effect, since the record material 208 is detected at the pinch portion, regardless of the feed direction of the record material 208, the record material 208 can be securely detected by one detector. As a fifth effect, since the record material is detected at a position closest to a record portion, time lag and distance lag can be reduced.

In the eighth embodiment shown in FIGS. 19 and 20, when the detection levers 255 are disposed at a plurality of positions corresponding to the width of the record material 208 and the record material detectors including these detection levers 255 are used, these detectors can be used as sheet width detectors of the record material 208 as well as sheet detectors. In the eighth embodiment shown in these drawings, the motions of the detection levers 255 are detected by optical means such as photointerrupters. However, instead, detectors with electric contacts may be used. Likewise, the paper width detectors may be detectors with electric contacts.

(Ninth Embodiment)

Figure 21:
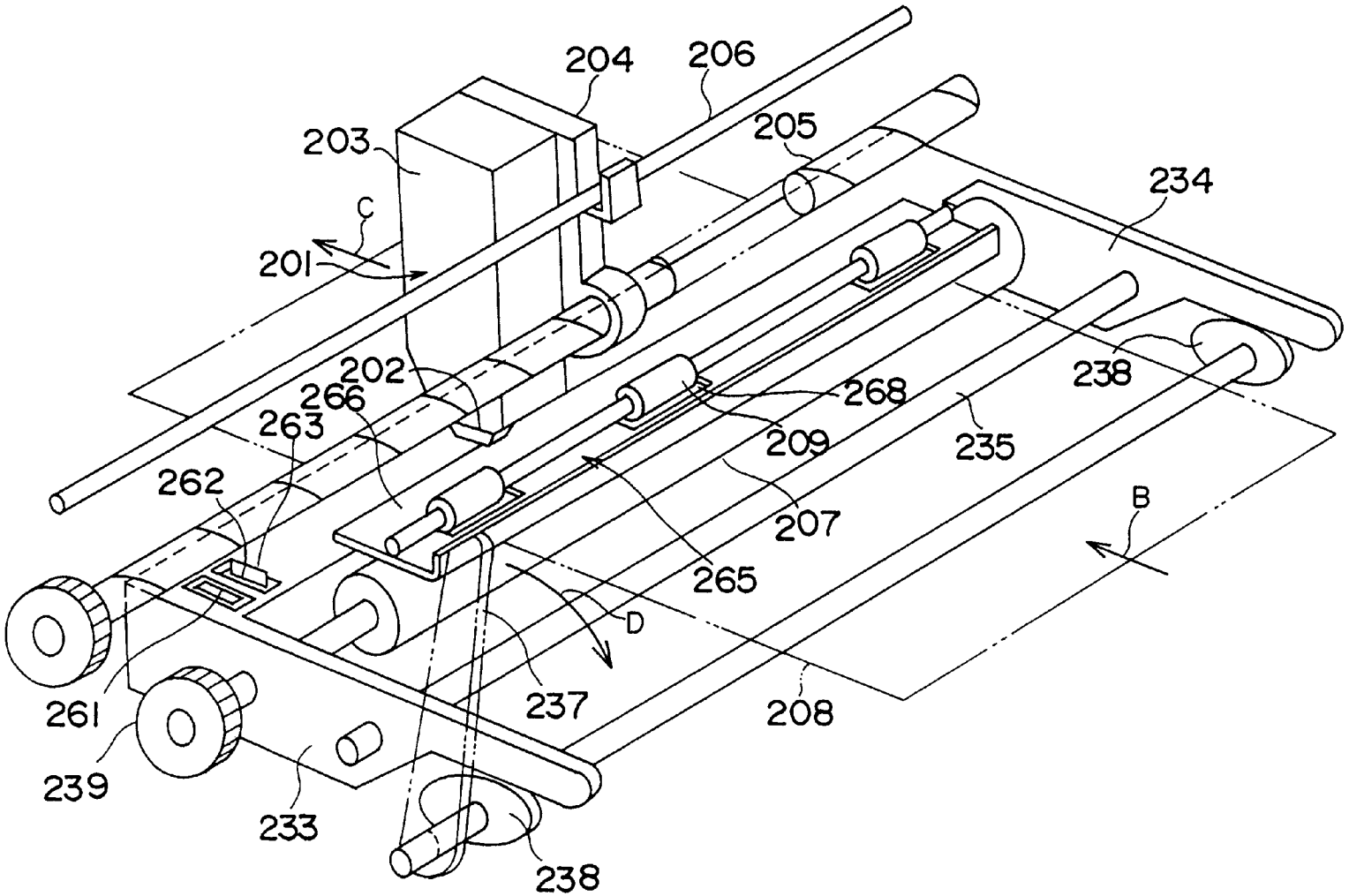
FIG. 21 is a schematic perspective view showing a recording apparatus according to a ninth embodiment of the present invention.

FIG. 21 is a schematic perspective view showing a paper feed mechanism of a recording apparatus according to a ninth embodiment of the present invention. In this embodiment, a paper feed roller and a pinch roller are disposed so that a record material is conveyed along a record means. A tension portion of a pinch roller to the paper feed roller and a tension portion of a pinch roller to a paper discharge roller are disposed adjacent to the record means. A record material guide means is disposed adjacent to the record means. The record material guide means extends along main scanning direction of the record means. The record material guide means is opposed to the record means. The record material guide means also works as a hold member of the pinch roller. In this embodiment, the recording apparatus is an ink jet recording apparatus.

In FIG. 21, reference numeral 201 is a detachable head cartridge where a record head (record means) 202 is incorporated with an ink tank 203. Reference numeral 204 is a carriage that holds the head cartridge 201. Reference numeral 205 is a guide shaft that reciprocatingly guides and holds the carriage 204. Reference numeral 206 is a guide shaft that slides and guides the carriage 204 in association with the guide shaft 205. Reference numeral 207 is a paper feed roller (conveying roller) that feeds a record material 208 such as a record paper sheet. Reference numeral 209 is a pinch roller that presses the paper feed roller 7 through the record material 208 so as to produce frictionally conveying force.

The record material 208, which is a sheet of paper, a plastic sheet, or the like, is conveyed in direction denoted by arrow B by the paper feed roller 207 and the pinch roller 209. After the record head 202 has recorded an image on the record material 208, the record material 208 is discharged in direction denoted by arrow C by a paper discharge roller or the like. The paper feed roller 207 is oscillationally supported about a shaft 235 that works as a supporting point through arm portions 233 and 234. The arm portions pivot both edge portions of the paper feed roller 207.

A cap member 261 is disposed at a home position of the record head 202. The cap member 261 is opposed to an ink discharge opening 81 of the record head 202. The cap member 261 is made of an air-tight elastic member such as rubber. The cap member 261 is moved by a drive means (not shown) so as to close or open the ink discharge opening 81. When an image is not recorded, the head cartridge 201 is moved to the home position. At this point, the cap member 261 is moved forward so as to air-tightly close the ink spray orifice 82 of the record head 202. A wiping blade 263 is disposed adjacent to the cap member 261. The wiping blade 263 is disposed on the holder 262. The wiping blade 263 is made of an elastic member such as silicon rubber or urethane rubber. In synchronization with the motion of the carriage 204, the wiping blade 263 removes adhered substances (such as ink, paper fibers, and dust) from the ink discharge opening 81 of the record head 202.

Figure 22:
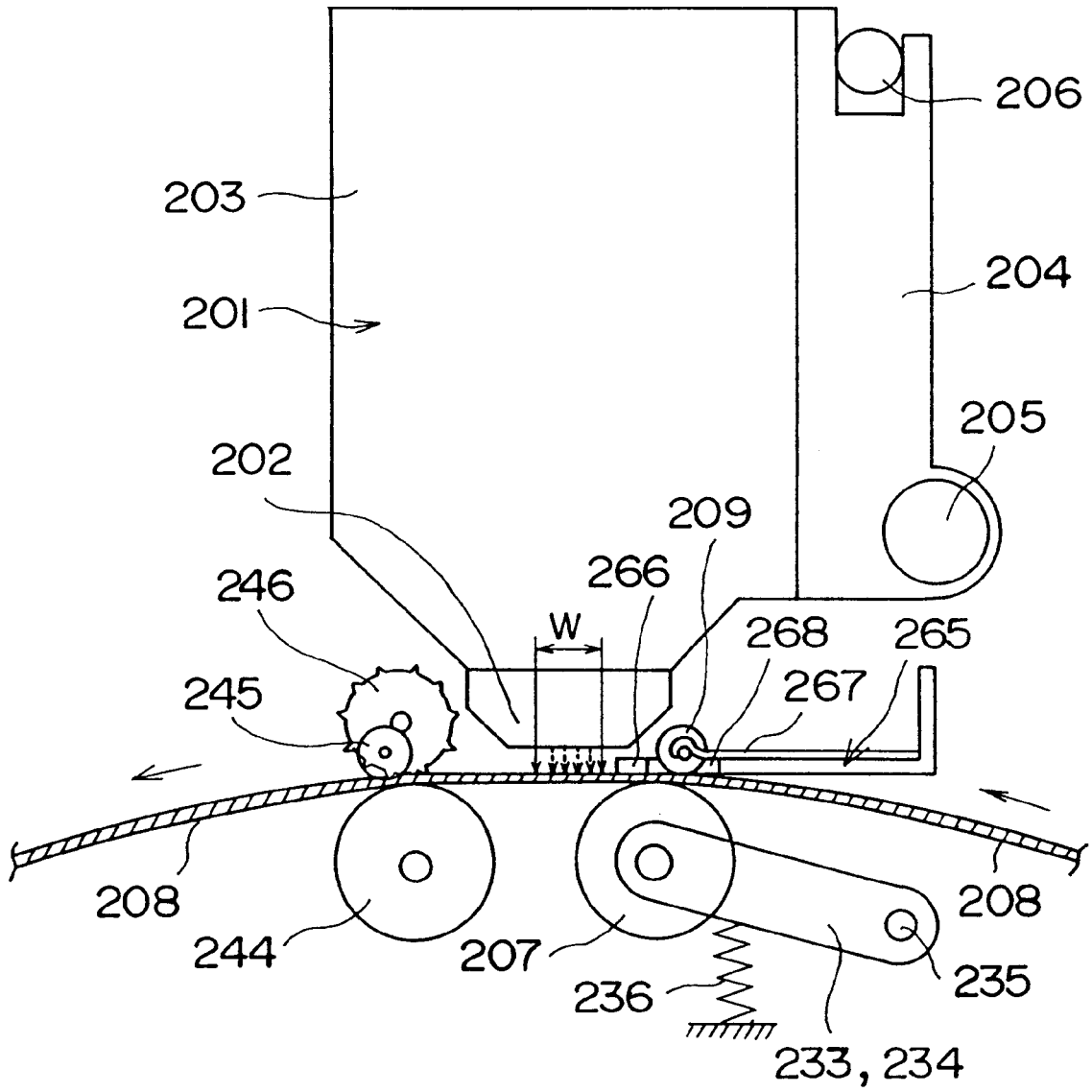
FIG. 22 is a vertical sectional view showing a paper feed direction of the recording apparatus of FIG. 21.
Figure 23:
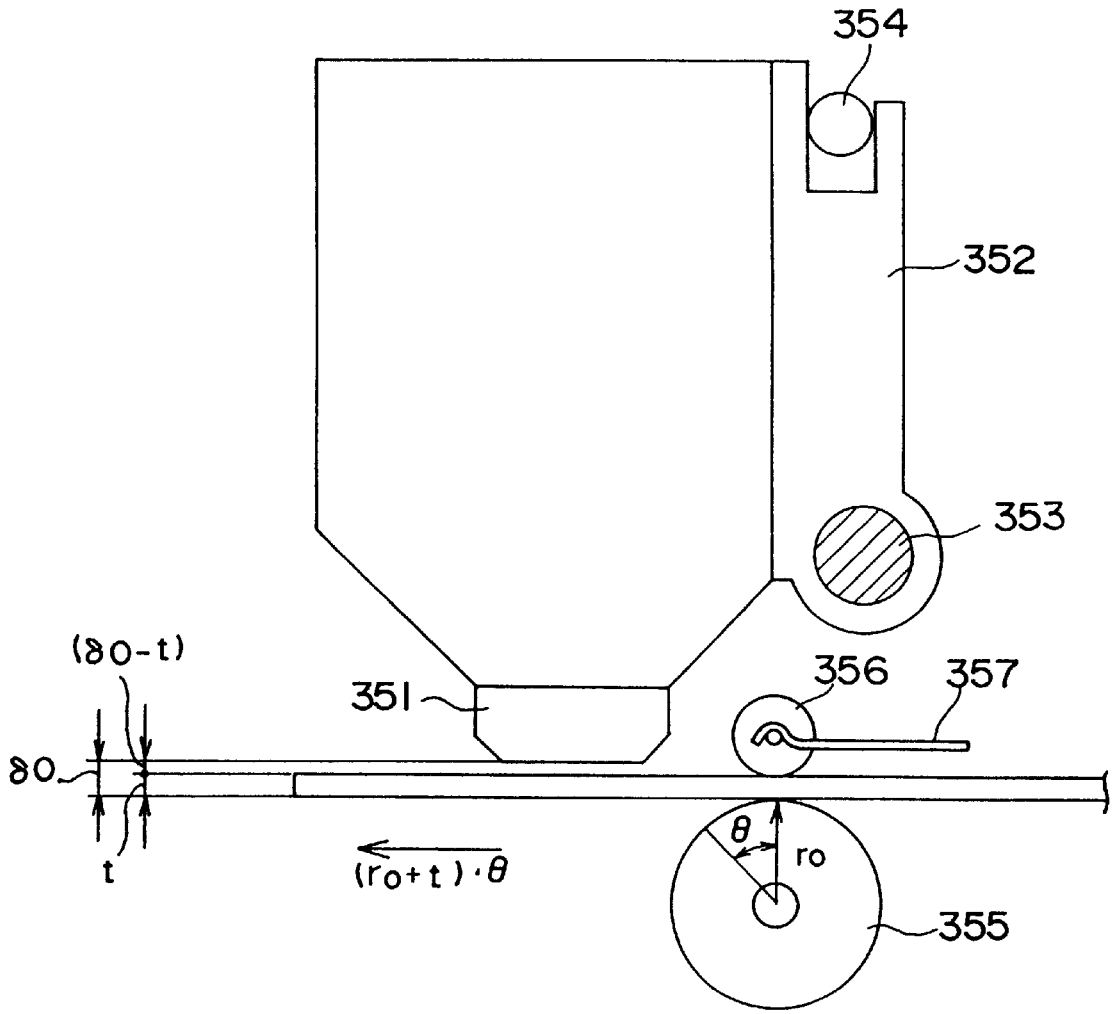
FIG. 23 PRIOR ART
FIG. 23 is a schematic perspective view showing a construction of a conventional recording apparatus.

FIG. 22 is a vertical sectional view in a paper feed direction of the recording apparatus of FIG. 21. In FIGS. 21 and 22, arm portions 233 and 234 that pivot the paper feed roller 207 are oscillationally disposed about a shaft 235. The arm portions 233 and 234 are biased to the pinch roller 209 by a tension spring 236 (see FIG. 22). Thus, the paper feed roller 207 is biased to the pinch roller 209 on the fixed shaft.

In FIG. 21, forward edge portions of the arm portions 233 and 234 are brought into contact with release cams 238 and 238 that are rotated by a release lever 237, respectively. Thus, when the release lever 237 is rotated in direction denoted by arrow D, the release cams 238 and 238 are rotated, thereby separating the paper feed roller 207 from the pinch rollers 209. A gear 239 is secured to one edge of the shaft portion of the paper feed roller 207. The paper feed roller 207 is rotated by a motor (not shown) through the gear 239. The carriage 204 is reciprocated by a carriage motor (not shown).

In FIG. 22, a paper discharge system is disposed downstream (in a record material conveying direction) of the record head 202. The paper discharge system is constructed of the paper discharge roller 244 and the pinch roller 245. Alternatively, the paper discharge system is constructed of the paper discharge roller 244 and the spur 246. In addition, an ink spray portion (having a plurality of ink discharge openings) is disposed on an ink discharge surface 81 of the record head 202. The width (namely, the length in the paper feed direction) of the ink discharge portion is w.

In FIGS. 21 and 22, a record material guide means 265 is disposed adjacent to and upstream (in the conveying direction of the record material 208) of the record head (record means) 202. The record material guide member 240 guides the record material 208 that is tensioned and pinched by the paper feed roller 207 and the pinch roller 209. When the forward edge portion (paper contact portion 266) of the record material guide member 265 is brought into contact with the record material 208, the record material 208 is guided along a predetermined conveying path. In this embodiment, the record material guide means 265 is constructed of a plate-shaped member that covers the paper width.

The record material guide means 265 has a support member 267 that rotatably supports the pinch roller 209. An opening 268 is formed corresponding to the pinch roller 209 of the record material guide means 265. The pinch roller 209 is in contact with the paper feed roller 207 through the opening portion 268.

In FIG. 22, the diameter of the pinch roller 209 is small. The pinch roller 209 is disposed at a position very close to the ink spray portion w of the record head 202. In addition, as shown in FIG. 22, the paper feed roller 207 and the pinch roller 209 are non-coaxially abutted. In other words, the paper feed roller 207 is disposed downstream (in the paper feed direction) of a pressure point (pinch portion) of the pinch roller 209 (namely, the paper feed roller 207 and the pinch roller are non-coaxially disposed) so that the record material 208 is conveyed along a sheet contact portion 266 of the record material guide means 265. The record material guide means 265 is disposed on the record means 201. The record material guide means 265 extends along the main scanning direction of the record means 201.

Thus, a paper feed roller 207 and a pinch roller 209 are disposed so that a record material 208 is conveyed along a record means 202. An abut portion of a pinch roller 209 to the paper feed roller 207 and an abut portion of a pinch roller 245 (including a spur 246) to a paper discharge roller 244 are disposed adjacent to the record means 202. A record material guide means 265 is disposed adjacent to the record means 202. The record material guide means 265 extends along main scanning direction of the record means 202. The record material guide means 265 is opposed to the record means 202. The record material guide means 265 also works as a hold member of the pinch roller 209.

According to the recording apparatus shown in FIGS. 21 and 22, the following effects can be obtained. As a first effect, since the trailing edge of the record material 208 is pinched by the pinch roller 245 or the spur 246 and the paper discharge roller 24, an image can be recorded on the record material 208 until the trailing edge of the record material 208 is just separated from the record material guide means 265. As a second effect, since the record material guide means 265 works for the entire width of the record material 208, the record material 208 can be accurately fed (conveyed) without being swelled and waved. As a third effect, since the record material guide means 265 is fixed, the record material 208 can be precisely fed.

As a fourth effect, since the record material guide means 265 is constructed with high rigidity, when the support mechanism of the pinch roller 209 or the like is disposed on the guide means 265, the rigidity of the apparatus can be enhanced, thereby improving the recording accuracy. As a fifth effect, since the record material 208 is guided by the guide means 265 in the vicinity of the record portion, the record material can be much prevented from being in contact with the ink discharge portion of the record head 202. As a sixth effect, since almost the limit of the trailing edge of the record material 208 is pinched, an image can be recorded almost at the trailing edge. In addition, since the leading edge is guided, the accuracy of the leading edge position is improved. Thus, the record accuracy can be improved.

When the record material guide means 265 is fixed, the distance between the ink discharge surface 81 of the record head 2 and the record material 208 is always kept constant regardless of the thickness of the paper to be used. When the distance should be changed corresponding to the record head, with a height adjustment mechanism of the record material guide means 65, the distance can be adjusted. Since the record material guide means 265 is disposed adjacent to the ink discharge portion w of the record head, the record material guide means 265 works as a protector against the ink discharge portion or the record material 208. In this embodiment, the paper feed roller 207 is tensioned to the pinch roller 209 on the fixed axis. However, it should be noted that the record material guide means 265 and the pinch roller 209 may be tensioned to the paper feed roller 207 on the fixed axis.

In the above-described embodiments, the recording apparatuses are ink jet recording apparatuses. However, the present invention is not limited to the ink jet recording apparatus. Rather, the present invention may be applied to a wire-dot type recording apparatus, a heat sensitive recording apparatus, a thermal transfer type recording apparatus, and the like. In these recording apparatuses, the same effects as the above-described embodiments can be obtained. In the above-described embodiments, the serial type recording apparatus, which moves the record means in main scanning direction, is explained. However, the present invention may be applied to a line type recording apparatus. The line type recording apparatus has a line record means that records an image in sub-scanning direction. In the line type recording apparatus, the same effects as the above-described embodiments can be obtained.

In the above-described embodiments, a monotone recording system, which records an image in a single color, is described. However, the present invention may be applied to a color recording system and a tone recording system. In these systems, a plurality of record means are used. However, the color recording system records an image in a plurality of colors corresponding to the record means, whereas the tone recording system records an image in a plurality of tones of a single color corresponding to the record means. In other words, the present invention may be applied to a variety of systems regardless of the number of record means and the number of recording colors. In these cases, the same effects as above-described embodiments can be obtained. In the above-described embodiment, the head cartridge, where the record means is incorporated with the ink tank, is used. However, the record means may be separated from the ink tank and they may be connected with an ink supply tube. Thus, the present invention may be applied to various constructions of the record means and the ink tank. In these constructions, the same effects as the above-described embodiments can be obtained.

The present invention may be applied to the ink jet recording apparatus with a record means (record head) using an electric-mechanical converting element such as piezo element. However, the ink jet recording apparatus with a record means that discharges ink using thermal energy can provide excellent effects where an image can be densely and precisely recorded.

It is preferable to employ a drive signal of the pulse signal type disclosed in U.S. Pat. No. 4,463,359 and U.S. Pat. No. 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid specifications, a structure disclosed in U.S. Pat. No. 4,558,333 and U.S. Pat. No. 4,459,600 in which the heated portion is disposed in a bent portion is included in the scope of the present invention. Furthermore, the present invention can effectively be embodied in a structure in which a common slit is made to be the discharge portion of a plurality of electrothermal conversion members and which is disclosed in Japanese Patent Laid-Open No. 59-123670 and a structure in which an opening for absorbing thermal energy pressure wave is formed to align to the discharge port and which is disclosed in Japanese Patent Laid-Open No. 59-138461.

A full line type recording head having a length which corresponds to the width of the maximum recording medium which can be recorded on by the recording apparatus may be a structure capable of realizing the aforesaid length and formed by combining a plurality of recording heads as disclosed in the aforesaid specifications or a structure formed by a integrally formed recording head. The present invention will enable the aforesaid effects to be exhibited further effectively.

In addition, the present invention can also be effectively adapted to a structure having an interchangeable chip type recording head which can be electrically connected to the body of the apparatus or to which ink can be supplied from the body of the apparatus when it is mounted on the body of the apparatus or a cartridge type recording head integrally formed to the recording head.

When the record head of the recording apparatus of the present invention is provided with a recovery means and a preliminary means, the effects of the present invention can be more stably accomplished. Examples of these means are a capping means, a cleaning means, a pressuring/sucking means for the record head, an electric-thermal converting element, another heating element, a preliminary heating means thereof, and a preliminary non-recording discharge mode.

In the above-described embodiments, one record head corresponding to for example black ink is used. However, the number of record heads is not limited to one. Instead, a plurality of record heads corresponding to colors or tones may be used. In other words, the present invention may be very effectively applied to any constructions of a single-head single-color (for example, block) system, a head-ink incorporated system, a multi-color system, and a sull-color system (mixed colors).

In addition, according to the present invention, ink is explained as liquid. However, the ink for use in the present invention may be a temperature-softening (liquefying) ink. In an ink jet system, the temperature of ink is controlled so that the viscosity thereof becomes stable in the range of 30° C. to 70° C. Thus, ink that is liquified corresponding to a record signal may be used. The temperature rise due to heat energy can be prevented by using status change energy from solid state to liquid state of ink. In other words, the present invention can be applied to any construction where ink is liquified by heat energy.

In this case, as disclosed in Japaense Patent Laid-Open Nos. 54-56847 and 60-71260, ink that is held in a cavity portion or a through-hole of a porous sheet may be opposed to an electric-thermal converting element. In the present invention, the above-described membrane boiling system is preferably employed. In addition to the image output terminals of information processing units such as computers, the ink jet recording apparatus according to the present invention may be used as copiers with a reader, facsimile units with transmission and reception functions, and so forth.

As described above, according to the fifth embodiment, which is a recording apparatus with a record means for recording an image on a record material, a paper feed roller support member pivots both edges of a paper feed roller about a roller drive shaft. A spring is disposed on the paper feed roller support member so as to tension the paper feed roller to the pinch roller. A lever portion that releases the paper feed roller from the pinch roller against the spring tension is disposed on one side of the roller support member. Thus, the support mechanism on both sides of the paper feed roller are incorporated. Thus, the recording apparatus with the sheet roller support mechanism that can securely perform the release operation can be constructed with fewer constructional members and in a smaller space.

According to the sixth embodiment, which is a recording apparatus with a record means that records an image on a recording sheet, a pair of extension roller portions that rotate along with a paper feed roller are coaxially disposed outside a pair of bearings disposed both edges of the paper feed roller. The paper feed roller, the extension roller portions, and the pinch roller are tensioned so that the record material is equally pressed on the full width thereof. Thus, the length of the paper feed roller can be functionally increased without needing to increase the size of the apparatus. In addition, the paper feed roller can be prevented from getting loose. As a result, a recording apparatus that has a small diameter roller and high sheet feed accuracy can be accomplished.

According to the seventh embodiment, which is a recording apparatus with a record means that records an image on a record material, a record material guide member is disposed adjacent to and upstream of a record means. At least a contact portion of the record material guide member to the record material is formed of an outer layer that has water repelling characteristics, low frictional coefficient to the record material, and high wearing resistance. Thus, the record material is smoothly fed at the contact portion. Consequently, the load of the paper feed motor can be reduced. As a result, the record material can be prevented from being scratched and stained. In addition, since the record material can is kept from being twisted and wrinkled while an image is recorded. Thus, a recording apparatus with a paper feed mechanism that improves recording accuracy and recording quality can be provided.

According to the eighth embodiment, which is a recording apparatus with a record means that records an image on a record material, a groove portion is disposed on a paper feed roller. A sheet contact portion of a detector that detects the record material is disposed inside the groove portion and between pinch rollers so as to detect whether the record material is present at a position of a record material pressing drive portion in a paper feed direction. Thus, the size of the recording apparatus can be reduced. In addition, the record material can be detected at a position where the record material is most tensioned. As a result, the record material can be securely detected without being moved and a recording apparatus with a paper feed mechanism that reduces time lag and distance lag between paper detection and image recording can be provided.

According to the ninth embodiment, which is a recording apparatus with a record means that records an image on a record material, axial positions of a paper feed roller and a pinch roller are disposed so that the record material is conveyed along the record means. In addition, a contact portion of the paper feed roller and the pinch roller and a contact portion of a paper discharge roller and its pinch roller are disposed adjacent to the record means. A record material guide means that extends in main scanning direction of the record means is disposed adjacent to the record means. The record material guide means works as a hold member of the pinch roller. Thus, an image can be recorded from a leading edge to a trailing edge of the record material. Thus, the sheet feed operation can be accurately performed. In addition, swelling and waving of the record material can be prevented.

What is claimed is:

1. An image forming apparatus, comprising:

image forming means for forming an image on a sheet;

position restricting means in contact with a surface of the sheet facing said image forming means for keeping constant a distance between the sheet and said image forming means, said position restricting means having a rotation member which is contactable with the sheet and has a center point of which is fixed;

a pressing rotation member for pressing the sheet to the rotation member, wherein the rotation member and said pressing rotation member are adjacently disposed upstream of said image forming means in a sheet conveying direction;

bias means for biasing said pressing rotation member toward the rotation member;

a first oscillation arm for rockably supporting said pressing rotation member in correspondence with a thickness of the sheet;

second rotation member and a third rotation member cooperating with said second rotation member, each disposed downstream of said image forming means for nipping the sheet, said second rotation member located at a side of said image forming means and being fixed in position;

a second oscillation arm for rockably supporting said third rotation member in correspondence with a thickness of the sheet;

a drive gear for driving said pressing rotation member and said third rotation member, said first oscillation arm and said second oscillation arm being supported oscillatably about a rotation center of said drive gear as a fulcrum;

first drive force transmitting means for transmitting a drive force from said drive gear to said dressing rotation member; and second drive force transmitting means for transmitting a drive force from said drive gear to said third rotation member.

2. The image forming apparatus according to claim 1, wherein the second rotation member has a plurality of protrusions on an outer periphery thereof being in contact with the sheet.

3. The image forming apparatus according to claim 1, wherein a peripheral speed of the third rotation member is larger than a peripheral speed of the first rotation member.

4. The image forming apparatus according to claim 1, wherein said image forming means includes an ink jet head for discharge of ink to form an image.

5. The image forming apparatus according to claim 4. wherein the ink jet head discharges ink particles by heat energy.

6. An image forming apparatus, comprising:

image forming means for forming an image on a sheet;

a rotation member disposed adjacent to said image forming means in contact with a surface of the sheet facing to said image forming means, and rotated about a rotation axis for keeping constant a distance between the sheet and said image forming means, wherein a center position of said rotation member is fixed;

a pressing rotation member for pressing the sheet to said rotation member, wherein said rotation member and said pressing rotation member are adjacently disposed upstream of said image forming means;

bias means for biasing said pressing rotation member toward said rotation member;

a first oscillation arm for rockably supporting said pressing rotation member in correspondence with a thickness of the sheet;

a second rotation member and a third rotation member cooperating with said second rotation member, each disposed downstream of said image forming means for nipping the sheet, said second rotation member located at a side of said image forming means and being fixed in position;

a second oscillation arm for rockably supporting said third rotation member in correspondence with a thickness of the sheet;

a drive gear for driving said pressing rotation member and said third rotation member, said first oscillation arm and said second oscillation arm being supported oscillatably about a rotation center of said drive gear as a fulcrum;

a first gear train for transmitting a drive force from said drive gear to said pressing rotation member; and a second gear train for transmitting a drive force from said drive gear to said third rotation member.

7. The image forming apparatus according to claim 6, wherein said image forming means includes an ink jet head for discharging ink to form an image.

8. The image forming apparatus according to claim 7, wherein the ink jet head discharges ink particles by heat energy.

9. An image forming apparatus, comprising:

image forming means for forming an image on a sheet;

a rotation member in contact with a surface of the sheet facing said image forming means, wherein a center position of said rotation member is fixed;

a pressing rotation member for pressing the sheet to said rotation member, wherein said rotation member and said pressing rotation member are adjacently disposed upstream of said image forming means;

bias means for biasing said pressing rotation member toward said rotation member;

a first oscillation arm for rockably supporting said pressing rotation member in correspondence with a thickness of the sheet;

a second rotation member and a third rotation member cooperating with said second rotation member, each disposed downstream of said image forming means for nipping the sheet, said second rotation member located at a side of said image forming means and being fixed in position;

a second oscillation arm for rockably supporting said third rotation member in correspondence with a thickness of the sheet;

a drive gear for driving said pressing rotation member and said third rotation member, said first oscillation arm and said second oscillation arm being supported oscillatably about a rotation center of said drive gear as a fulcrum;

a first gear train for transmitting a drive force from said drive gear to said pressing rotation member; and a second gear train for transmitting a drive force from said drive gear to said third rotation member.

10. The image forming apparatus according to claim 9, wherein said rotation member is disposed adjacent to said image forming means.

11. The image forming apparatus according to claim 9, wherein said image forming means is adapted for forming an image on a stopped sheet of a predetermined length in a conveying direction of the sheet, and said rotation member is adapted for conveying the sheet for the predetermined length whenever the image of the predetermined length is formed.

12. The image forming apparatus according to claim 9, wherein said image forming means includes an ink jet head for discharging ink so as to form an image.

13. The image forming apparatus according to claim 12, wherein said ink jet head discharges ink particles by heat energy.

14. An image forming apparatus, comprising:

a first rotation member and a second rotation member cooperating with it for nipping and conveying a sheet, said first rotation member having a rotation center fixed;

a first oscillation arm for rockably supporting said second rotation member in correspondence with a thickness of the sheet;

an image forming means disposed downstream of said first and second rotation members for forming an image on a surface of the sheet with which said first rotation member is contacted;

a third rotation member and a fourth rotation member disposed downstream of said image forming means cooperating for nipping the sheet, said third rotation member located at a side of said image forming means and having a rotation center fixed;

a second oscillation arm for rockably supporting said fourth rotation member in correspondence with a thickness of the sheet;

a drive gear for driving said second rotation member and said fourth rotation member, said first oscillation arm and said second oscillation arm being supported oscillatably about a rotation center of said drive gear as a fulcrum;

a first gear train for transmitting a drive force from said drive gear to said second rotation member; and a second gear train for transmitting a drive force from said drive gear to said fourth rotation member.

* * * * *

UNITED STATES PATENT AND TRADEMARK OFFICE

CERTIFICATE OF CORRECTION

PATENT NO. : 5,980,132

DATED : November 9, 1999

INVENTOR(S): TSUTOMU KAWAI

It is certified that error appears in the above-identified patent and that said Letters Patent is hereby corrected as shown below:

COVER PAGE AT ITEM [56] RC,
Foreign Patent Documents: "303872 12/1990 Japan" should read --2-303872 12/1990 Japan--, and "225077 10/1986 Japan" should read --61-225077 10/1986 Japan--.

COLUMN 5,
Line 19, "the" (2nd occurrence) should be deleted.

COLUMN 6,
Line 10, "1b" should read --16--.

COLUMN 7,
Line 38, "idler" should read --an idler--.

COLUMN 8,
Line 55, "has" should read --have--.

COLUMN 10,
Line 30, "roller" should read --rollers--; and
Line 39, "disturbed" should read --distributed--.

COLUMN 11,
Line 33, "silicon" should read --silicone--.

UNITED STATES PATENT AND TRADEMARK OFFICE

CERTIFICATE OF CORRECTION

PATENT NO. : 5,980,132

DATED : November 9, 1999

INVENTOR(S): TSUTOMU KAWAI

It is certified that error appears in the above-identified patent and that said Letters Patent is hereby corrected as shown below:

COLUMN 15,
Line 3, "silicon" should read --silicone--.

COLUMN 17,
Line 62, "a" should read --an--.

COLUMN 19,
Line 14, "since" should be deleted; and
Line 15, "can" should be deleted.

COLUMN 20,
Line 1, "second" should read --a second--.

Signed and Sealed this

Fourteenth Day of November, 2000

*Attest:*

*Attesting Officer*

Q. TODD DICKINSON

*Director of Patents and Trademarks*